US006874872B2

(12) United States Patent
Lewis et al.

(10) Patent No.: US 6,874,872 B2
(45) **Date of Patent: *Apr. 5, 2005**

(54) MONITORING AND CONTROLLING INK PRESSURIZATION IN A MODULAR INK DELIVERY SYSTEM FOR AN INKJET PRINTER

(75) Inventors: Richard H Lewis, Barcelona (ES); Eric L Gasvoda, Salem, OR (US); Xavier Gasso Puchal, Barcelona (ES); Antonio Monclus, Barcelona (ES); John A. Barinaga, Portland, OR (US)

(73) Assignee: Hewlett-Packard Development, L.P., Houston, TX (US)

( * ) Notice: Subject to any disclaimer, the term of this patent is extended or adjusted under 35 U.S.C. 154(b) by 74 days.

This patent is subject to a terminal disclaimer.

(21) Appl. No.: 09/912,406

(22) Filed: Jul. 24, 2001

(65) Prior Publication Data

US 2002/0047881 A1 Apr. 25, 2002

Related U.S. Application Data

(63) Continuation of application No. 09/495,666, filed on Feb. 1, 2000, now Pat. No. 6,290,343, which is a continuation-in-part of application No. 08/988,018, filed on Dec. 10, 1997, now Pat. No. 6,030,074, which is a continuation of application No. 08/679,579, filed on Jul. 15, 1996, now abandoned, and a continuation-in-part of application No. 09/240,039, filed on Jan. 29, 1999, now Pat. No. 6,206,512, and a continuation-in-part of application No. 08/871,566, filed on Jun. 4, 1997, now Pat. No. 6,074,042.

(51) Int. Cl.[7] ..... B41J 2/175
(52) U.S. Cl. ..... 347/85
(58) Field of Search ..... 347/84–87; 222/92, 222/95, 97, 207, 209, 212, 214

(56) References Cited

U.S. PATENT DOCUMENTS

| | | | | | |
|---|---|---|---|---|---|
| 6,030,074 | A | * | 2/2000 | Barinaga | 347/85 |
| 6,074,042 | A | * | 6/2000 | Gasvoda et al. | 347/50 |
| 6,206,512 | B1 | * | 3/2001 | Gasso et al. | 347/85 |
| 6,224,198 | B1 | * | 5/2001 | Cook et al. | 347/85 |
| 6,290,343 | B1 | * | 9/2001 | Lewis et al. | 347/85 |

FOREIGN PATENT DOCUMENTS

| | | | |
|---|---|---|---|
| JP | 5-318760 | * | 3/1993 |
| JP | 10-138506 | * | 5/1998 |

* cited by examiner

*Primary Examiner*—Michael Nghiem
(74) *Attorney, Agent, or Firm*—Peter I. Lippman

(57) ABSTRACT

An air pressurization system is incorporated as part of a replaceable auxiliary ink supply for an inkjet printer. The auxiliary ink-supply cartridge includes a pressurized container having air, ink and electrical-signal connections. The air pressure applied to the auxiliary ink supply is monitored to maintain it in a predetermined range in accordance with a start-up sequence, and operational sequence, a waiting time, and a close-down sequence.

15 Claims, 30 Drawing Sheets

Section 5B – 5B

| Operating Mode | Pressure Relief Valve | Approximate Air Pressure |
|---|---|---|
| System Error | Open | Zero |
| New Ink System Installed–Air Purge From Ink Tubes | Open Δ/Closed | 1.5 psi |
| Prime Printheads With Positive Ink Pressure | Open Δ/Closed | .2 psi |
| Replace Printhead | Open | Zero |
| Replace Ink Cartridge | Open | Zero |
| Normal Printing | Closed | 2.5 psi |
| Overnight Non–use | Open | Zero |

FIG. 23

MONITORING AND CONTROLLING INK PRESSURIZATION IN A MODULAR INK DELIVERY SYSTEM FOR AN INKJET PRINTER

RELATED APPLICATIONS

The present application is a continuation of U.S. application Ser. No. 09/495,666, filed Feb. 1, 2000 now U.S. Pat. No. 6,290,343 by the present inventors, which was in turn a continuation-in-part of U.S. application Ser. No. 08/988,018 filed Dec. 10, 1997 by John Barinaga entitled METHOD AND APPARATUS FOR DELIVERING PRESSURIZED INK TO A PRINTHEAD (now U.S. Pat. No. 6,030,074), which is a continuation of U.S. application Ser. No. 08/679,579 filed Jul. 15, 1996 now abandoned. The parent application is also a continuation-in-part of U.S. application Ser. No. 09/240,039 filed Jan. 29, 1999, by Xavier Gasso and Antonio Monclus entitled REPLACEABLE INK DELIVERY TUBE SYSTEM FOR LARGE FORMAT PRINTER (now U.S. Pat. No. 6,206,512). The parent application is also a continuation-in-part of U.S. application Ser. No. 08/871,566 filed Jun. 4, 1997 by Eric L. Gasvoda, et al. entitled REPLACEABLE INK CONTAINER ADAPTED TO FORM RELIABLE FLUID, AIR AND ELECTRICAL CONNECTION TO A PRINTING SYSTEM (now U.S. Pat. No. 6,074,042). All of these applications are commonly owned by the assignee of the present application and are incorporated herein by reference.

FIELD OF INVENTION

The present invention generally relates to print cartridges used in computer controlled printers, and more particularly, to methods and apparatus for delivering ink to such print cartridges.

BACKGROUND OF INVENTION

One problem in ink-jet printing is that some applications require a large supply of ink. For example, "large format" applications use large size printing media (for example, 22 inch×34 inch, 34 inch×44). Examples of large format applications include computer aided design (engineering drawings), mapping, graphic arts, and posters. The large format printed image can use a large amount of ink either because of the large printed area needing to be covered with ink or the use of 100 percent filled-in image areas, or both. Therefore, it is desirable to have ink reservoirs that contain a large amount of ink to avoid replacing an empty ink reservoir in the middle of a printing cycle or the frequent changing of the ink reservoir between printing jobs.

However, merely increasing the size of the ink reservoir in an on-board system to hold more ink has not proved to be an acceptable solution. The ink reservoir is supported on the printer carriage and moves with the printhead. Increasing the amount of ink in motion would necessarily require an increase in the size and weight of the structure that supports and moves the carriage back and forth. The increased mass of the carriage would also significantly increase the cost of the printer (for example, larger and more expensive electrical motors).

In response, recently, relatively large ink reservoir systems have developed in which the reservoir is mounted off-board.

In contrast to on-board ink reservoirs, printing systems using off-board reservoirs require means for delivering the ink from the off-board ink reservoir to the printhead. Pumps can be used for such delivery, but such pumps have problems associated with their use. For example, the ingredients in the ink can be incompatible with the pump components, and such components as diaphragms and seals can degrade when exposed to the ink solvents for extended time periods.

A second problem in ink-jet ink delivery arises in color printing. Color printing typically uses multiple ink reservoirs, each containing ink of a different hue. Since each ink reservoir must be individually pressurized, multiple pumps can be used. However, the addition of each additional pump increases the cost of the overall printing system. Thus, it would be desirable to use one pump that can provide the necessary pressure for all the ink reservoirs individually.

One other problem in ink-jet technology is that customers have different purchasing criteria. Some customers, with high ink usage rate, may prefer the lower "unit price" of a large ink reservoir. Other customers, may prefer a lower, "start-up" price of a smaller ink reservoir. Thus, it would be beneficial for the customers to have a printing system that is adaptable to ink reservoirs with different sizes. In addition, the manufacturer also benefits when the size of the ink reservoir is not a limiting factor in the design of the printer or the ink delivery system.

SUMMARY OF THE INVENTION

Briefly and in general terms, an apparatus for delivering pressurized ink to a printhead, according to the invention, includes a deformable bag for holding ink, a pressurizable container substantially surrounding the bag for exerting fluid pressure on said bag and pressurizing any ink within the bag, and a sealable ink outlet port for fluid communication with the ink bag. The port is fluidically connectable to the printhead so that pressurized ink is deliverable to the printhead.

The invention contemplates a process having the steps of: providing a deformable bag for holding ink for a printhead; substantially surrounding the bag with a pressurizable container; exerting fluid pressure on the bag by pressurizing the container, thereby pressurizing any ink within the bag; and delivering pressurized ink to the printhead.

In a presently preferred embodiment of the invention, the air pressure system is incorporated as part of a replaceable auxiliary ink supply as well as part of a replaceable ink delivery system having air, ink and electric signal connections to the auxiliary ink supply. The air pressure applied to the auxiliary ink supply is monitored to be maintained in a predetermined range in accordance with a start-up sequence, an operational sequence, a waiting time, and a close-down sequence.

BRIEF DESCRIPTION OF THE DRAWINGS

FIG. 23 shows various operational modes for the pressure relief valve.

DESCRIPTION OF THE PREFERRED EMBODIMENTS

Figure 1A:
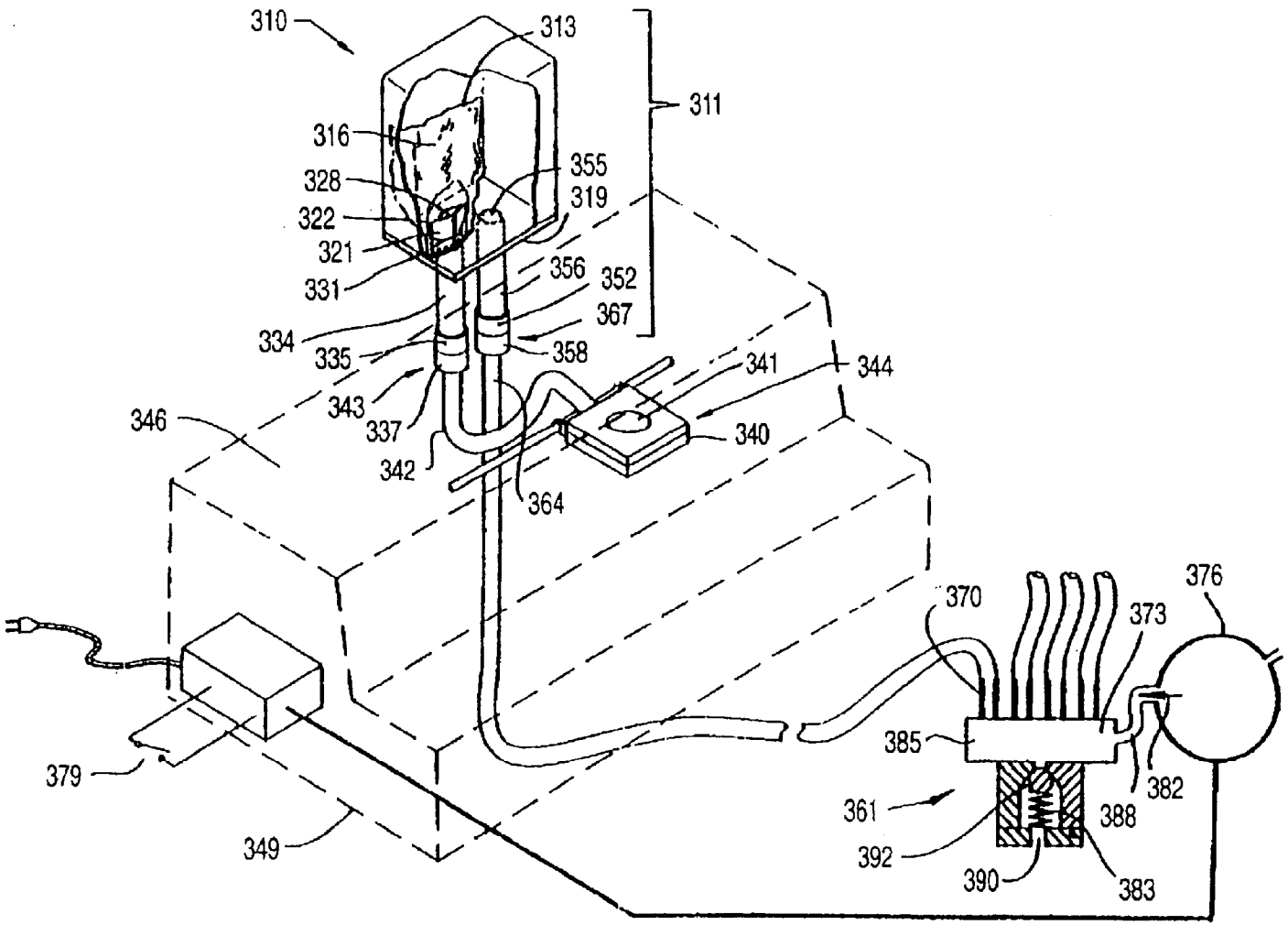
FIG. 1A is a perspective view, partially in section and partially cut away, of an apparatus for delivering pressurized ink to a printhead embodying the principles of the present invention.

Referring to FIG. 1A, reference numeral 310 generally indicates a pressurizable container for exerting fluid pressure on a deformable ink bag 313 which contains a liquid ink 316.

The container 310 is an air impermeable rigid container which houses the ink bag 313. The container 310 is attached to a chassis 319 to form a hermetic seal. A method for securing such a seal is to choose the same material, such as HDPE (high density polyethylene), for both the chassis 319 and the container 310 and to use an attachment process such as ultrasonic welding, or heat staking, or adhesive bonding. A gas inlet port 355 allows pressurized air 373 to flow into the container 310. Later versions use an O-ring seal between the container and chassis.

The ink bag 313 is constructed from a multi-layer metallized polymer film, such as metallized PET (polyethylene terephthalate), with a sealant layer made of LDPE (low density polyethylene). The bag 313 has a high barrier property to water diffusion and other solvents present in the ink 316. The ink bag 313 can be of any shape and size suitable for holding the ink 316. The ink bag 313 is flexible, deformable, and collapses when its contents are emptied.

The ink bag 313 is heat staked onto an external surface 321 of a fin 322 to make a hermetic, fluid tight seal. Also, the fin 322 is attached to the chassis 319 to form a hermetic, fluid tight seal. A method for making the fin to chassis seal is to choose the same material, such as HDPE (high density polyethylene), for both the chassis 319 and the fin 322 and to use an attachment process such as ultrasonic welding, or heat staking, or adhesive bonding. In the preferred embodiment the fin 322 has a diamond shape for manufacturing ease. The fin 322 has two ports, an ink inlet port 328 and an ink outlet port 331. The fin 322 is connected to a first ink conduit 334 at the ink outlet port 331. The first ink conduit has a sealable outlet port 325 and is connected to a second ink conduit 342 by a first male connector 337. The sealable ink outlet port 325 provides fluid communication with the print cartridge.

The first male connector 337 is located on a base 346 of a printer 349. The first ink conduit 334 and the second ink conduit 342 are made of a material with high barrier property, such as FEP (fluorinated ethylene propylene), to prevent diffusion of air and ink solvents (including water). The ink 316 is in fluid communication with a print cartridge 344 via the bag 313, the fin 322, the first ink conduit 334 and the second ink conduit 342. Thick LLDPE (linear low density polyethylene) tube material has been used more recently.

Referring to FIG. 1A, reference numeral 344 generally indicates the print cartridge connected to the second ink conduit 342. The print cartridge also includes a printhead 340. The print cartridge is of conventional thermal ink-jet construction and operation. The print cartridge 344 also includes a pressure regulator 341 for maintaining a preset back pressure (for example, minus 2 inches of water) required for the printhead 340 to function. When the pressure inside the printhead 340 is lower than atmospheric pressure, a condition exists that is called back pressure (or negative pressure). Back pressure is necessary to keep ink from drooling out of the nozzles (not shown here) of the printhead 340. The pressure regulator 341 is in fluid communication with the ink 316 in the second ink conduit 342 on one side, and the printhead 340 on the other side. Depending on the pressure inside the printhead 340, the pressure regulator 341 allows or stops the flow of the ink 316 to the printhead 340.

Figure 2A:
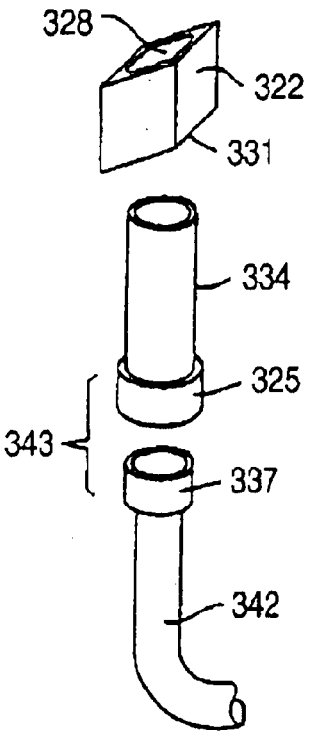
FIG. 2A is an isometric exploded view of a fluid connection between a pressurizable container and a quick ink disconnect valve.
Figure 2B:
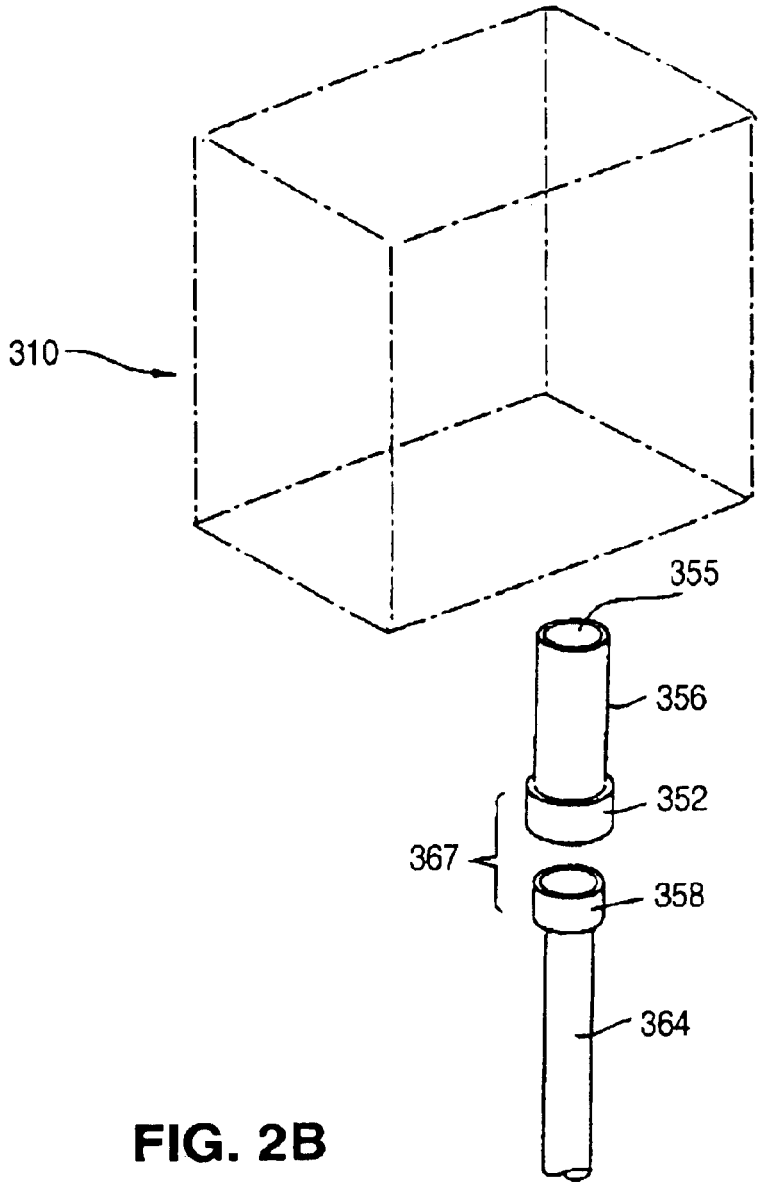
FIG. 2B is an isometric, exploded view of a fluid connection between the pressurizable container and a quick air disconnect valve.

Further referring to FIGS. 1A, 2A and 2B, the container 310 is in fluid communication with a first gas conduit 356 having a sealable gas inlet port 352 and the gas inlet port 355. The gas inlet port 355 is received in the container 310. The first gas conduit 356 is connected to a second gas conduit 364. The second gas conduit has a second male connector 358 that is insertable into the sealable gas inlet port 352. The sealable gas inlet port 352 and the second male connector 358 together, make a second quick disconnect valve 367. See FIG. 2B. The second male connector 358 is located on the base 346 of the printer 349.

The container 310, the ink bag 313, the fin 322, the chassis 319, the first ink conduit 334, the first gas conduit 356, the sealable ink outlet port 325, and the sealable gas inlet port 352 are collectively referred to as an ink containment device 311.

Referring to FIG. 1A, reference numeral 361 generally indicates an air manifold. The air manifold 361 contains a first gas outlet port 370 for providing air 373 to the container 310 via the second gas conduit 364. The number of the first gas outlet ports 370 on the manifold is a matter of design to accommodate all the pressurizable containers 310 that house the ink bags 313. Only one container and ink bag is illustrated in FIG. 1 avoid redundancy. In a typical color ink-jet printing device there are four ink reservoirs: black, magenta, cyan, and yellow. Thus, on such a color printer the air manifold 361 has four first gas outlet ports 370. An air compressor 376 is electrically connected to the printer 349 so that the compressor 376 is turned on when the printer 349 signals the air compressor. The air compressor 376 has a second gas outlet port 382 which is connected to an air chamber 385 in the air manifold 361 via a third gas conduit 388. The air compressor 376 can be any commercially available unit capable of providing air at a pressure of about 2 psi and at an air flow rate of about 150 cc/min. More recent innovations use a pressure season with a more powerful compressor as described in more detail below. The air manifold 361 has an air bleed vent 390 for providing a continuous bleed. The bleed vent is a commercially available ball 392 and spring 393. The purpose of the continuous bleed is to minimize the exposure of the seals in the system to an elevated pressure when the printer is not in operation and second, to equilibrate the system's pressure and to avoid over pressurization during operation. When the pressure inside the air chamber 385 exceeds the desired pressure of 2 psi, the ball 392 compresses the spring 393 to allow excess air to exit through the air bleed vent 390.

Referring to FIGS. 1A, 2A and 2B, in operation, the first male connector 337 and the second male connector 358 are inserted into the sealable ink outlet port 325 and the sealable gas inlet port 352, respectively. These insertions bring the ink containment device 311 in fluid communications as shown in the drawings.

When the air compressor 376 is turned on, the air 373 flows in turn through the second gas outlet port 382, the third gas conduit 388 and into the air chamber 385. The air 373 is then directed to the first gas outlet port 370 and thereafter through the second gas conduit 364, the second quick disconnect valve 367, the first gas conduit 356, the gas inlet port 355 and into the container 310.

The pressure of the air inside the container 310 exerts a pressure on the ink bag 313 containing the ink 316. This pressure causes the ink 316 to flow through the ink inlet port 328 and thereafter through the fin 322, the ink outlet port 331, the first ink conduit 334, the first quick disconnect valve 343, the second ink conduit 342 and into the pressure regulator 341.

As the ink is jetted out of the printhead 340, the pressure inside the print head 340 decreases until it reaches a preset back pressure. The difference between the back pressure on one side of the pressure regulator 341, in communication with the printhead 340, and the more positive ambient air pressure creates a pressure differential that causes the pressure regulator 341 to open and to allow the ink 316 to flow into the printhead 340. When the pressure in the printhead 340 reaches the preset operating pressure, the flow of ink stops and the differential pressure across the pressure regulator is equilibrated.

Figure 1B:
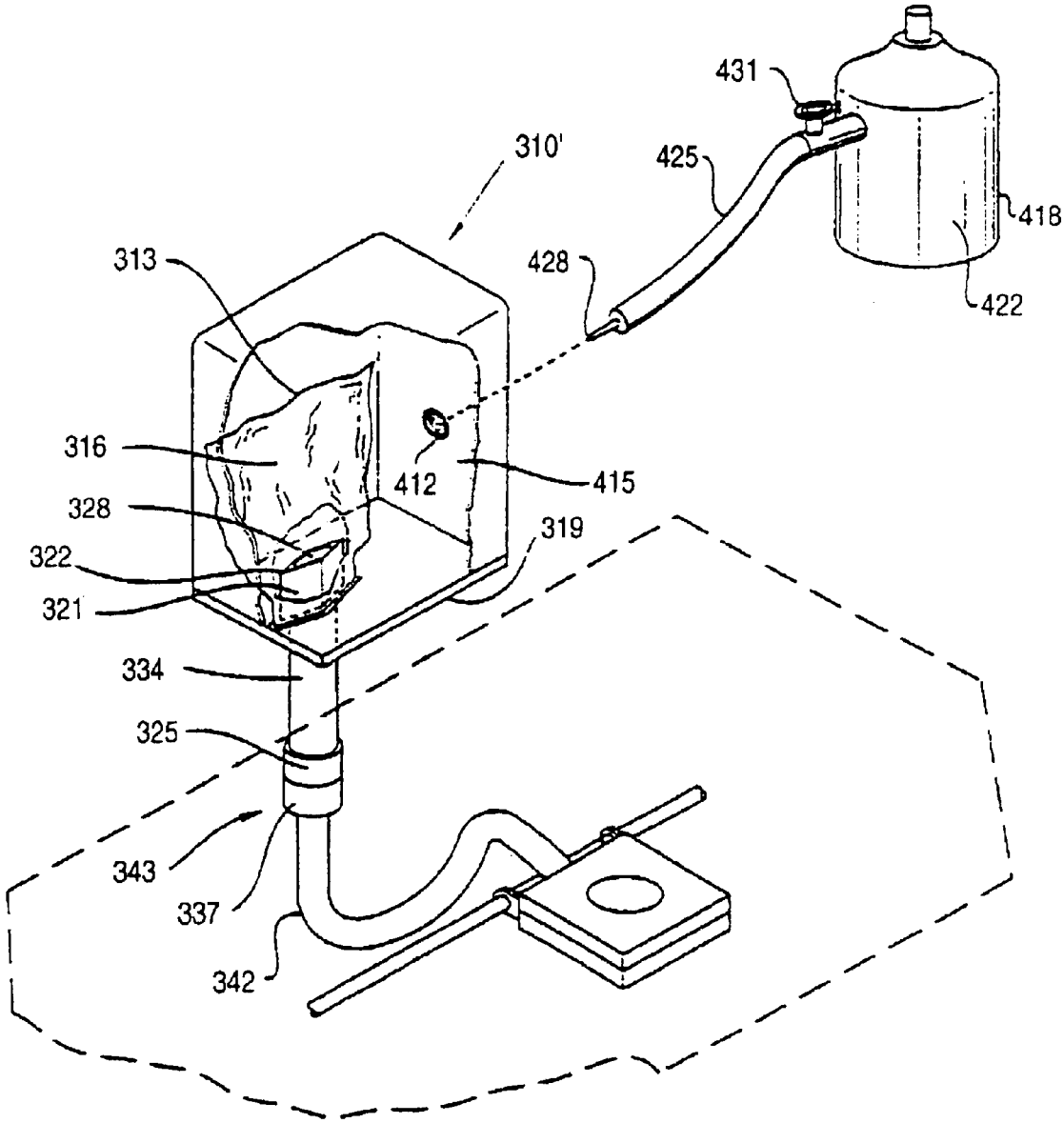
FIG. 1B is a perspective view, partially in section and partially cut away, of a second embodiment of the present invention showing a pressurized fluid in fluid communication with a pressurizable container.

FIG. 1B illustrates another embodiment of the present invention. For the two embodiments like reference numerals indicate like components. In referring to FIG. 1B reference numeral 310' generally indicates a pressurizable container for exerting pressure on the deformable ink bag 313 which contains the liquid ink 316. A sealable fluid inlet 412, such as a septum, is located in a sidewall 415 of the container 310' for receiving a pressurized fluid 422 such as air. A pressurized fluid cylinder 418 holds the pressurized fluid 422. The pressurized fluid 422 is in fluid communication with the container 310 through a pressure regulator 431, a fluid conduit 425, and a hollow needle 428 which connects to the inlet 412. The pressure regulator is commercially available and is set for a pressure of about 2 psi. The fluid conduit 425 is made of any material that can support an air pressure of about 2 psi.

Referring to FIG. 1B, in operation, the hollow needle 428 is inserted into the septum 412. The pressurized fluid cylinder 418 is opened and the pressurized fluid 422 moves through the pressure regulator 431, the fluid conduit 425, the needle 428, and into the container 310. The needle 428 can remain in the septum during normal operation. Upon inserting the first male connector 337 into the sealable ink outlet port 325, the system is ready for operation in the same manner as described above in connection with FIG. 1A.

It should be appreciated that: any pressurizable fluid, including a liquid, that is compatible with the pressurization system can be used in place of the air 373 and the fluid 422; the fin 322 has a diamond shape but any other shape that can accommodate the ink bag 313 and the chassis 319 can be used; the preset back pressure is minus 2 inches of water but the pressurization system described here can accommodate any other back pressure requirements that the printhead 340 may have; only one type of air compressor 376 is described but any type of pump capable of providing the desired air pressure and flow rate may be used such as those pumps used in fish aquariums; and the desired pressure in the ink conduits, the gas conduits, and the containers 310 and 310' is 2 psi but pressures in the range from minus 10" of water to over 45 psi can be used.

Figure 3:
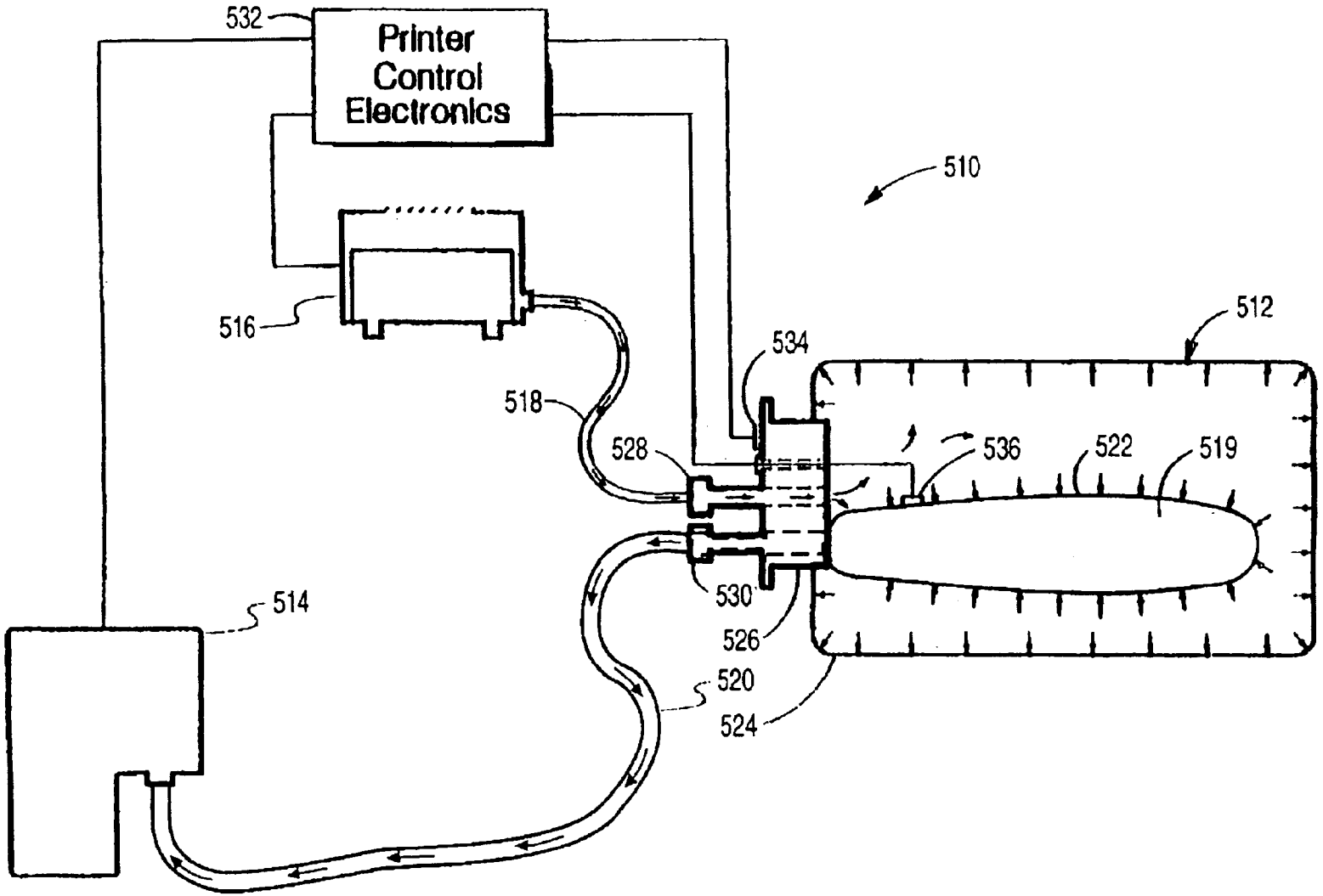
FIG. 3 depicts a schematic representation of a printing system that includes an ink container of the present invention.

FIG. 3 depicts a schematic representation of a printing system 510 with a different ink container 512 of the present invention. Also included in the printing device 510 is a printhead 514 and a source of pressurized gas such as a pump 516. The pump 516 is connected by a conduit 518 for providing a pressurized gas such as air to the ink container 512. A marking fluid 519 such as ink is provided by the ink container 512 to the printhead 514 by a conduit 520. This marking fluid is ejected from the printhead 514 to accomplish printing.

The ink container 512 which is the subject of the present invention includes a fluid reservoir 522 for containing ink 519, an outer shell 524, and a chassis 526. In the preferred embodiment the chassis 526 includes a air inlet 528 configured for connection to conduit 518 for pressurizing the outer shell 524 with air. A fluid outlet 530 is also included in the chassis 526. The fluid outlet 530 is configured for connection to the conduit 520 for providing a fluid connection between the fluid reservoir 522 and fluid conduit 520.

In the preferred embodiment the fluid reservoir 522 is formed from a flexible material such that pressurization of the outer shell produces a pressurized flow of ink from the fluid reservoir 522 through the conduit 520 to the printhead 514. The use of a pressurized source of ink in the fluid reservoir 522 allows for a relatively high fluid flow rates from the fluid reservoir 522 to the printhead 514. The use of high flow rates or high rates of ink delivery to the printhead make it possible for high throughput printing by the printing system 510.

Figure 4A:
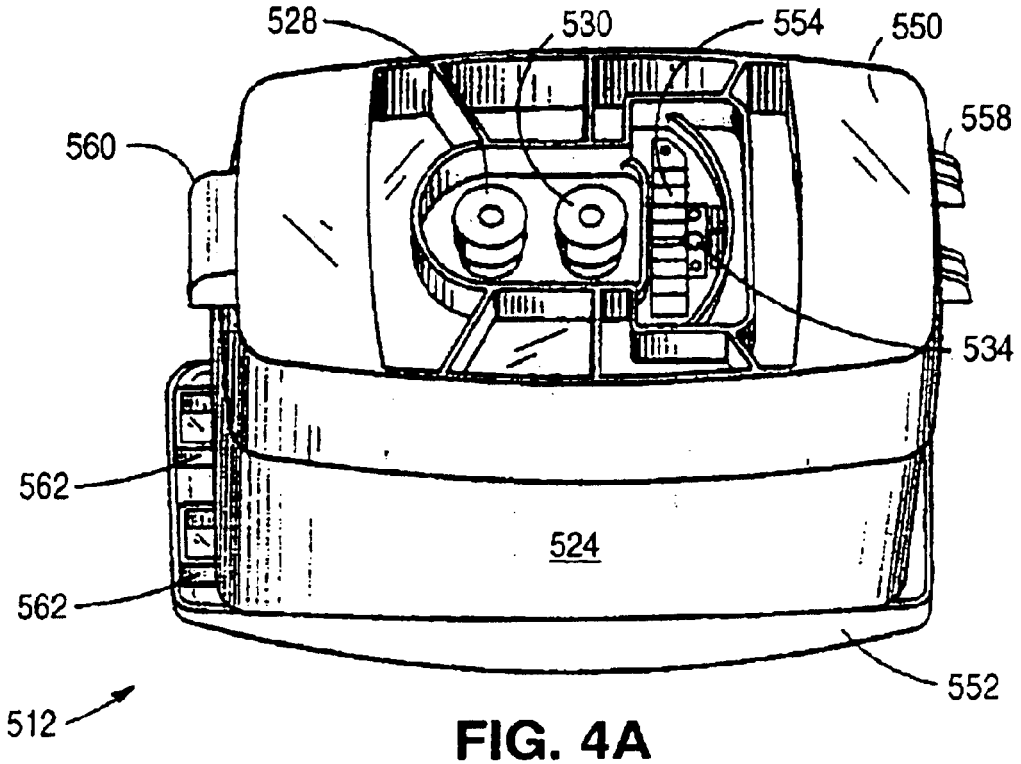
FIG. 4A depicts a perspective view of a leading edge portion of the ink container.

The ink container 512 also includes a plurality of electrical contacts, as will be discussed in more detail with respect to FIG. 4. The electrical contacts provide electrical connection between the ink container 512 and printer control electronics 532. The printhead control electronics 532 controls various printing system 10 functions such as, but not limited to, printhead 514 activation to dispense ink and activation of pump 516 to pressurize the ink container 512. In one preferred embodiment the ink container 512 includes an information storage device 534 and an ink level sensing device 536. The information storage device 534 provides information to the printer control electronics 532 for controlling printer 510 parameters such as ink container 512 volume as well as ink characteristics, to name a few. The ink level sense device 536 provides information relating to current ink volume in the ink container 512 to the printer control electronics 532.

As ink 519 in each ink container 512 is exhausted the ink container 512 is replaced with a new ink container 512 containing a new supply of ink. In addition, the ink container 512 may be removed from the printer chassis 538 for reasons other than an out of ink condition such as changing inks for an application requiring different ink properties or for use on different media. It is important that the ink container 512 be not only accessible within the printing system 510 but also easily replaceable. It is also important that the replacement ink container 512 form reliable electrical connection with corresponding electrical contacts associated with the printer chassis 538 as well as properly form necessary interconnects such as fluid interconnect, air interconnect and mechanical interconnect so that the printing system 510 performs reliably. The present invention is directed to a method and apparatus for reliably engaging the ink container 512 into the printer chassis 538 to insure proper electrical interconnection is formed.

It is important that ink spillage and spattering be minimized to provide reliable interconnection between the ink container 512 and printer 510. Ink spillage is objectionable not only for the operator of the printer who must handle the spattered ink container 512 but also from a printer reliability standpoint. Inks used in ink-jet printing frequently contain chemicals such as surfactants which if exposed to printer components can effect the reliability of these printer components. Therefore, ink spillage inside the printer can reduce the reliability of printer components thereby reducing the reliability of the printer.

FIGS. 3 and 4 depict the ink container 512 of the present invention. The ink container 512 includes a housing or outer shell 524 which contains the fluid reservoir 522 shown in FIG. 1 for containing ink 519. The outer shell 524 has a leading edge 550 and trailing edge 552 relative to a direction of insertion for the ink container 512 into the printer chassis 538. The leading edge 550 includes the air inlet 528 and the fluid outlet 530 which are configured for connection to the air pump 516 and the printhead 514, respectively, once the ink container 512 is properly inserted into the printer chassis 538. The air inlet 528 and fluid outlet 530 will be discussed in more detail below.

A plurality of electrical contacts 554 are disposed on the leading edge 550 for providing electrical connection between the ink container 512 and printer control electronics 532. In one preferred embodiment the plurality of electrical contacts 554 include a first plurality of electrical interconnects that are electrically interconnected to the information storage device 534 and a second plurality of electrical interconnects which are electrically interconnected to the ink volume sensor 536 shown in FIG. 3. In the preferred embodiment the information storage device 534 is a semiconductor memory and the ink volume sensing device 536 is an inductive sensing device. The electrical contacts 554 will be discussed in more detail with respect to FIG. 4C.

The ink container 512 includes one or more keying and guiding features 558 and 560 disposed toward the leading edge 550 of the ink container 512. The keying and guiding features 558 and 560 work in conjunction with corresponding keying and guiding features on the printer chassis 538 to assist in aligning and guiding the ink container 512 during insertion of the ink container 512 into the printer chassis 538. The keying and aligning features 558 and 560 in addition to providing a guiding function also provide a keying function to insure only ink containers 512 having proper ink parameters such as proper color and ink type are inserted into a given slot printer chassis 538. Keying and guiding features are discussed in more detail in co-pending patent application Ser. No. 08/566,521 filed Dec. 4, 1995 entitled "Keying System for Ink Supply Containers" assigned to the assignee of the present invention and incorporated herein by reference.

Figure 4B:
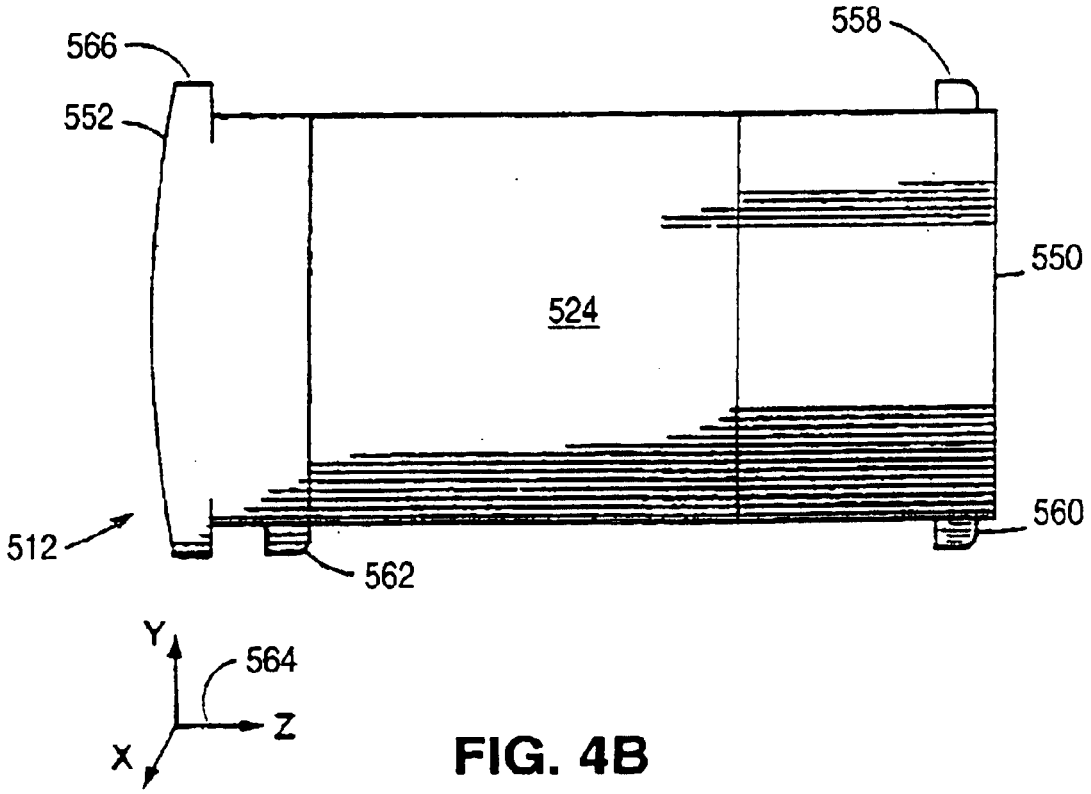
FIG. 4B depicts a side view thereof.

A latch feature 562 is provided toward the trailing edge 552 of the ink container 512. The latch feature 562 works in conjunction with corresponding latching features on the printer portion to secure the ink container 512 within the printer chassis 538 such that proper interconnects such as pressurized air, fluidic and electrical are accomplished in a reliable manner. The latching feature 562 is a molded tang which extends downwardly relative to a gravitational frame of reference. The ink container 512 shown in FIG. 4B is positioned for insertion into a printer chassis 538 along the Z-axis of coordinate system 564. In this orientation gravitational forces act on the ink container 512 along the Y-axis.

Figure 4C:
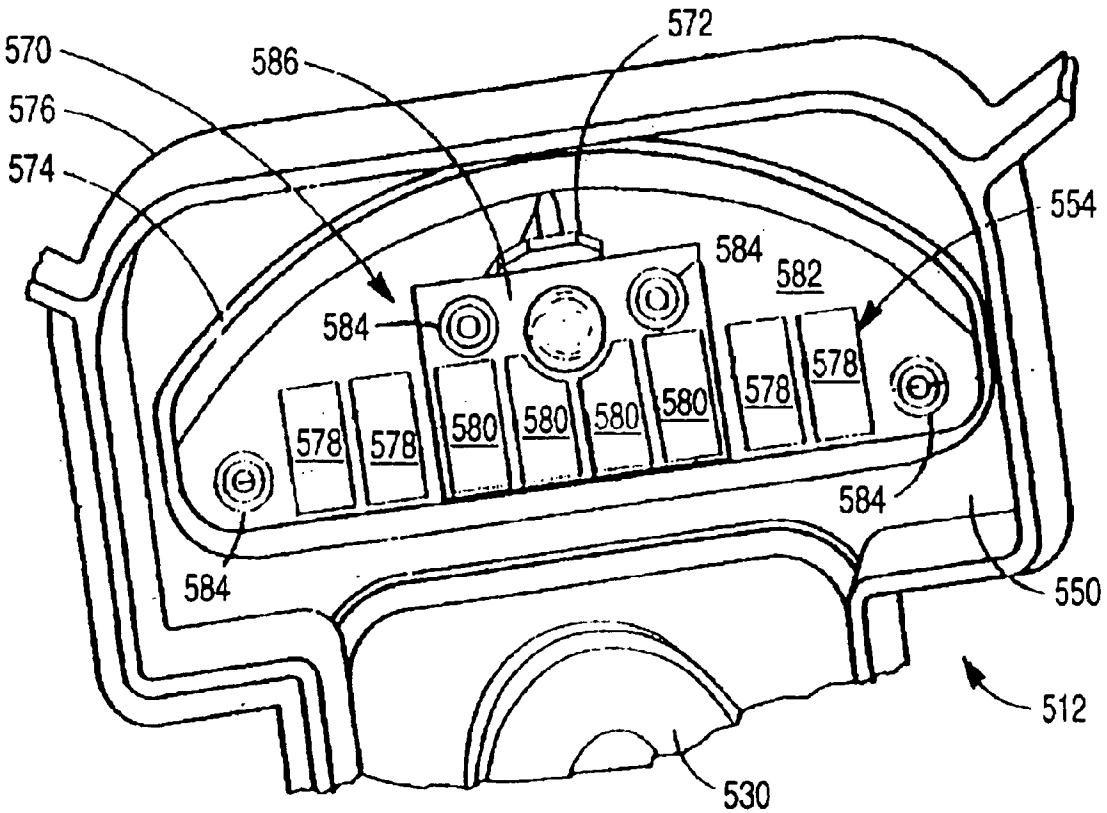
FIG. 4C depicts a plan view, partially broken away, of the electrical connection portion thereof.

FIG. 4C depicts an electrical interconnect portion 570 which includes electrical contacts 554 and upstanding guide member 572, and inner wall member 574, and an outer wall member 576. In the preferred embodiment, the plurality of electrical contacts 554 include electrical contacts 578 which are electrically connected to the fluid sensing device 536 shown in FIG. 3 and electrical contacts 580 which are electrically connected to the information storage device 534. In the preferred embodiment, the electrical contacts 578 are defined in a flexible circuit 582 which is mounted to the ink container 512 by fastener 584. A circuit 586 on which contacts 580 and information storage device 534 are disposed provides electrical connection between the information storage device 534 and contacts 580. The circuit 586 is attached to the ink container 512 by fastener 584.

The inner upstanding wall 574 and the outer upstanding wall 576 help protect the electrical circuit 586, information storage device 534, and contacts 578 and 580 from mechanical damage. In addition, the upstanding walls 574 and 576 help minimize inadvertent finger contact with the electrical contact 578 and 580. Finger contact with the electrical contact 578 and 580 can result in the contamination of these electrical contacts which can result in reliability problems with the electrical connection between the ink container 512 and the printing system 510. Finally, inadvertent contact with the electrical contact 578 and 580 can result in an electrostatic discharge (ESD) which can result in reliability problems with the information storage device 534. If the information storage device is particularly sensitive to electrostatic discharge such a discharge may result in catastrophic failure of the information storage device 534.

Figure 5A:
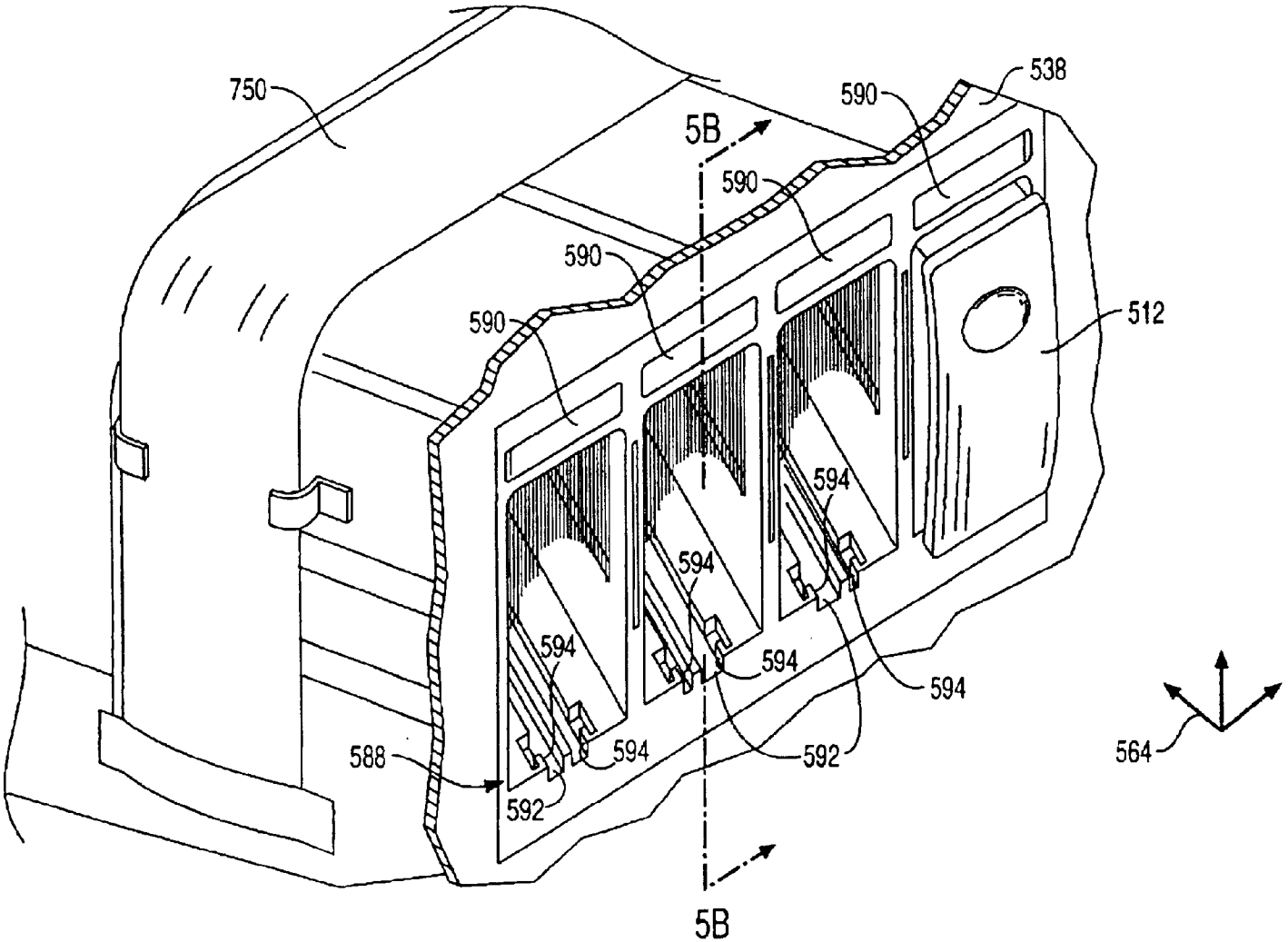
FIG. 5A depicts a perspective view of an ink container receiving station shown partially broken away with an ink container installed.

FIG. 5A depicts an ink container 512 of the present of the present invention shown secured within an ink container receiving station 588 within the printer chassis 538. Because ink container 512 is similar except for keying and guiding features 558 and 560 and corresponding ink properties contained within the respected fluid reservoir, the same reference numbering will be used for each ink container 512. An ink container indicia 590 may be positioned proximate each slot in the ink container receiving station 588. The ink container indicia 590 may be a color swatch or text indicating ink color to assist the user in color matching for inserting the ink container 512 in the proper slot within the ink container receiving station 588. As discussed previously the keying and guiding features 558 and 560 shown in FIGS. 4A–B prevent ink containers from being installed in the wrong slot. Installation of an ink container in the wrong slot can result in improper color mixing or the mixing of inks of different ink types each of which can result in poor print quality.

Figure 5B:
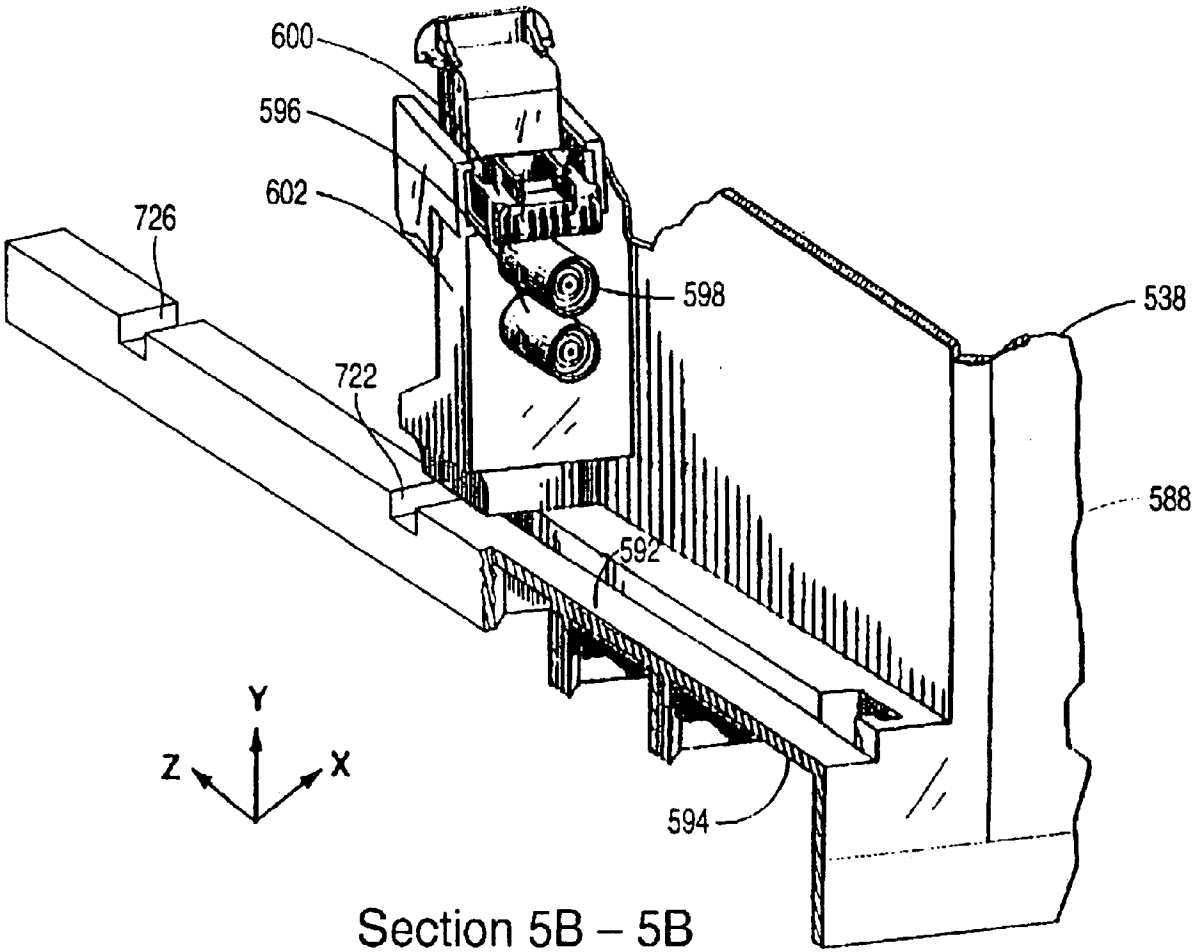
FIG. 5B depicts a cross-section taken across line 5B—5B of the ink container receiving station shown partially broken away.

Each receiving slot within the ink container receiving station includes a corresponding keying and guiding slot 592 and a recessed latching portion 594. The guiding slot 592 cooperates with the keying and guiding features 558 and 560 to guide the ink container 512 into the ink container receiving station 588. The keying and guiding slot 592 associated with the corresponding keying and guiding feature 560 is shown in FIGS. 5A–B and the keying and guiding slot associated with the corresponding keying and guiding feature 558 on the ink container 512 is not shown. The latching features 594 are configured for engaging the corresponding latching features 562 on the ink container 512.

FIG. 5B shows a cross-section of a single ink container receiving slot within the ink container receiving station 588. The ink container receiving slot includes interconnect portions for interconnecting with the ink container 512. In the preferred embodiment these interconnect portions include a fluid inlet 598, and air outlet 596 and an electrical interconnect portion 600. Each of the interconnects 596, 598, and 600 are positioned on a floating interconnect portion 602 which is biased along the Z-axis toward the installed ink container 512.

The fluid inlet 598 and the air outlet 596 associated with the ink container receiving station 588 are configured for connection with the corresponding fluid outlet 530 and air inlet 528, respectively on the ink container 512. The electrical interconnect 600 is configured for engaging the plurality of electrical contact 554 on the ink container 512.

Figure 6A:
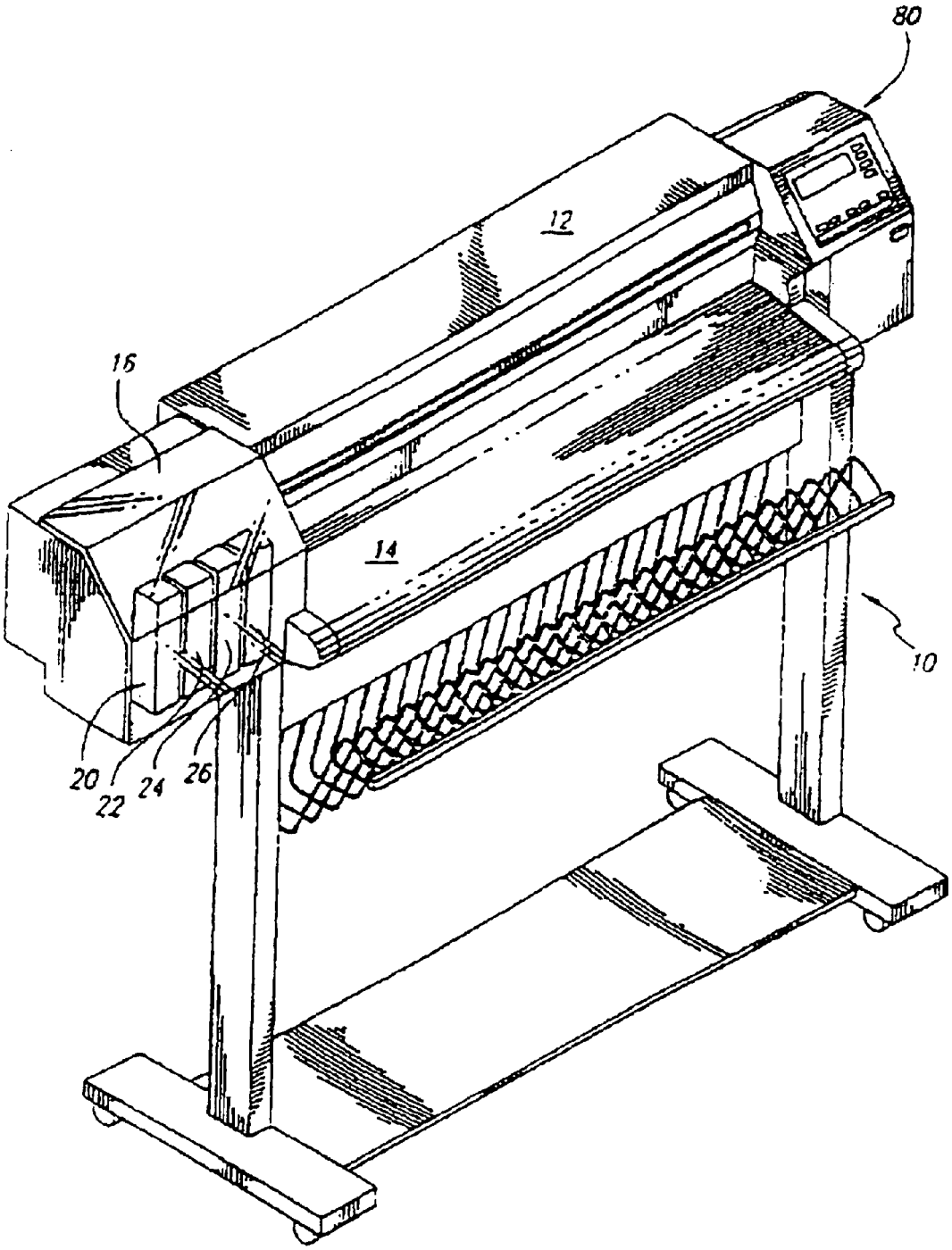
FIG. 6A is a perspective view of a large format printer incorporating the present invention.

FIG. 6A shows a large format printer 10 of the type which includes a transversely movable printhead carriage enclosed by a plastic or metal hinged cover 12 which extends over a generally horizontally extending platen 14 over which printed media is discharged. At the left side of the platen is a transparent hinged cover 16 which contains four removable ink reservoirs 20, 22, 24, 26 which, through a removable flexible tube arrangement to be described, supply ink to four inkjet printheads mounted on the moveable carriage.

Figure 6B:
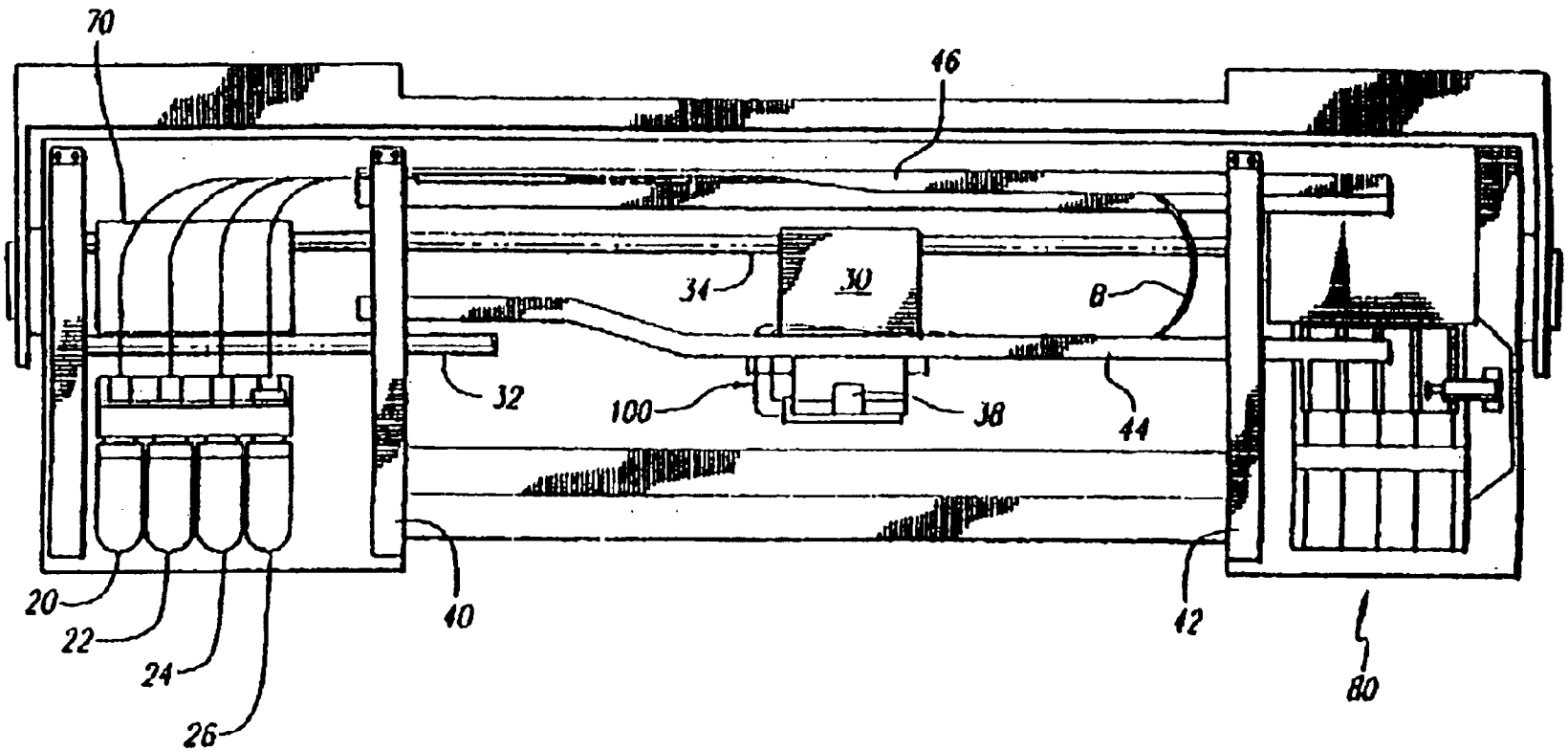
FIG. 6B is a top plan view thereof with its cover removed to show the printhead carriage and ink tube guides and supports.

In the plan view of FIG. 6B which the carriage cover 12 has been removed, it is seen that the printhead carriage 30 is mounted on a pair of transversely extending slider rods or guides 32, 34 which in turn are rigidly affixed to the frame of the printer. Also rigidly affixed to the frame of the printer are a pair of tube guide support bridges 40, 42 from which front and rear tube guides 44, 46 are suspended. The printhead carriage 30 has a pivotal printhead holddown cover 36 fastened by a latch 38 at the front side of the printer which securely holds four inkjet printheads, one of which is shown in FIG. 7 in place in stalls C, M, Y, B on the carriage. The front tube guide 44 is angled near the left bridge support 40 to provide clearance for opening the printhead cover when the carriage is slid to a position proximate the left side of the platen 14 so that the printhead holddown cover 36 can be easily opened for changing the printheads.

A replaceable ink delivery tube system described in more detail below conveys ink from the four separate ink reservoirs 20, 22, 24, 26 at the left side of the printer through four flexible ink tubes 50, 52, 54, 56 which extend from an ink reservoir connector 70 through the rear and front tube guides 44, 46 to a printhead connector 100 which is releasably affixed to the carriage 30.

At the right side of the printer is a printhead service station 80 at which the printhead carriage 30 may be parked for servicing such as wiping, spitting or priming the printheads.

Figure 11:
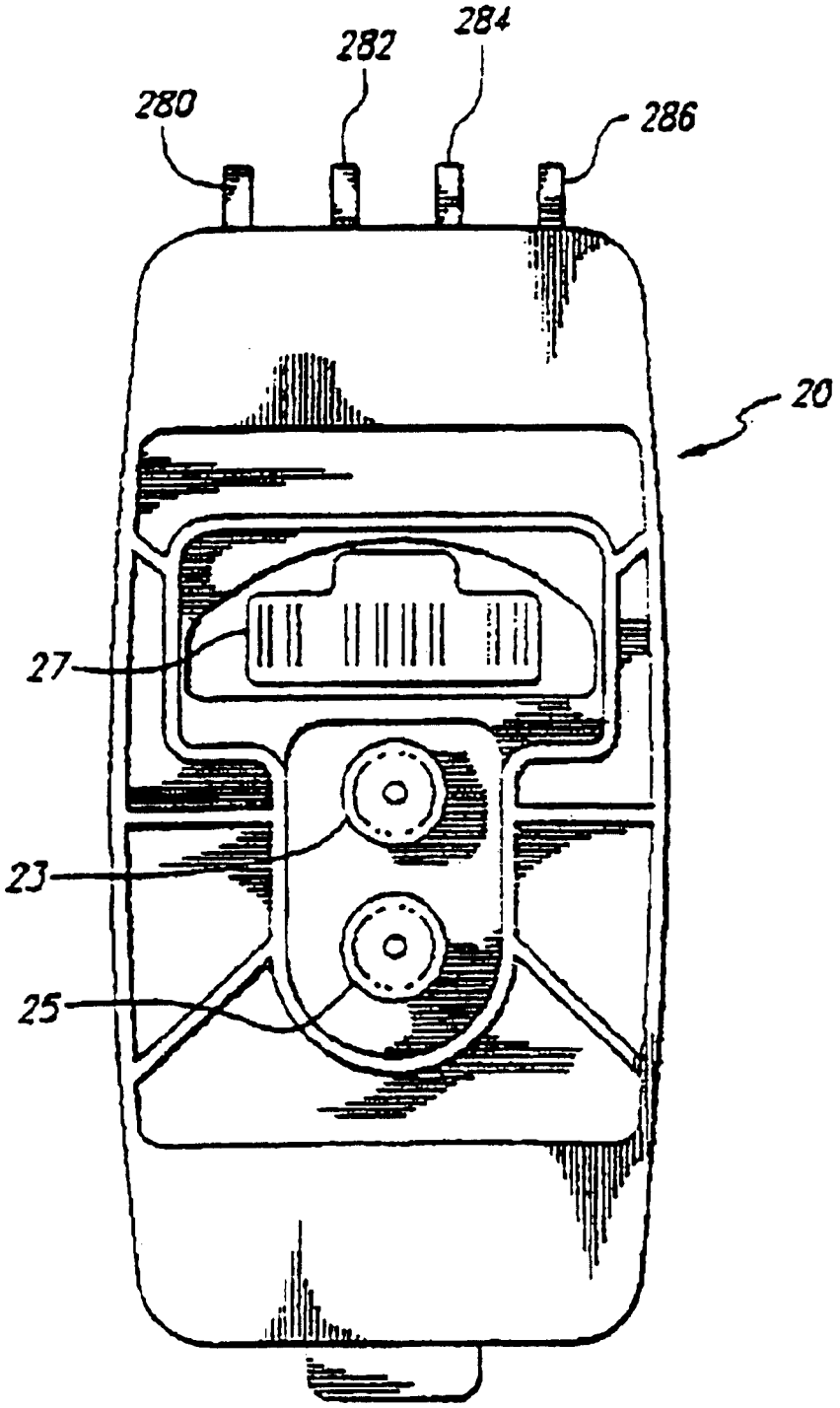
FIG. 11 is an elevation of the ink connection end of an ink reservoir having a fin configuration complementary with the fin configuration of the reservoir connector lockout of FIG. 10.

As seen in FIG. 6A each of the four ink reservoirs 20, 22, 24, 26 is easily accessible from the front of the printer when the optional cover 16 (seen in FIG. 1) is open so that the reservoirs can be easily installed, removed or replaced with new reservoirs. As is known in the art, three of the reservoirs each contain a different base color of ink such as cyan, magenta and yellow and the fourth reservoir contains black ink so that a high number of colors can be produced as desired during printing. FIG. 11 shows an ink connector 23, an air connector 25 and an electrical connector 27 on the front end of an ink reservoir 20. The other reservoirs are similarly constructed.

Figure 7A:
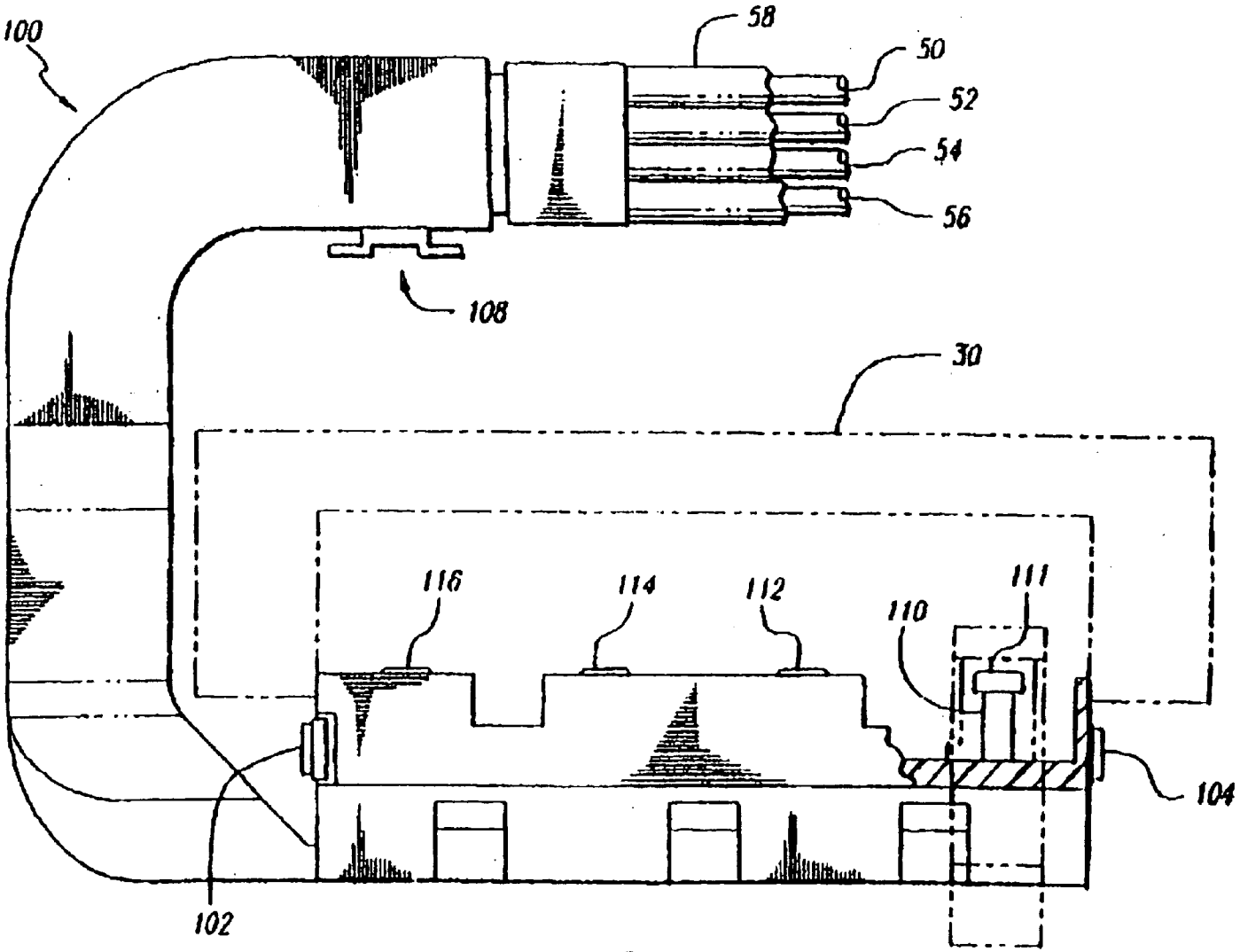
FIG. 7A is a front elevation view of the printhead connector, partly broken away, with a printhead carriage being shown in phantom.
Figure 7B:
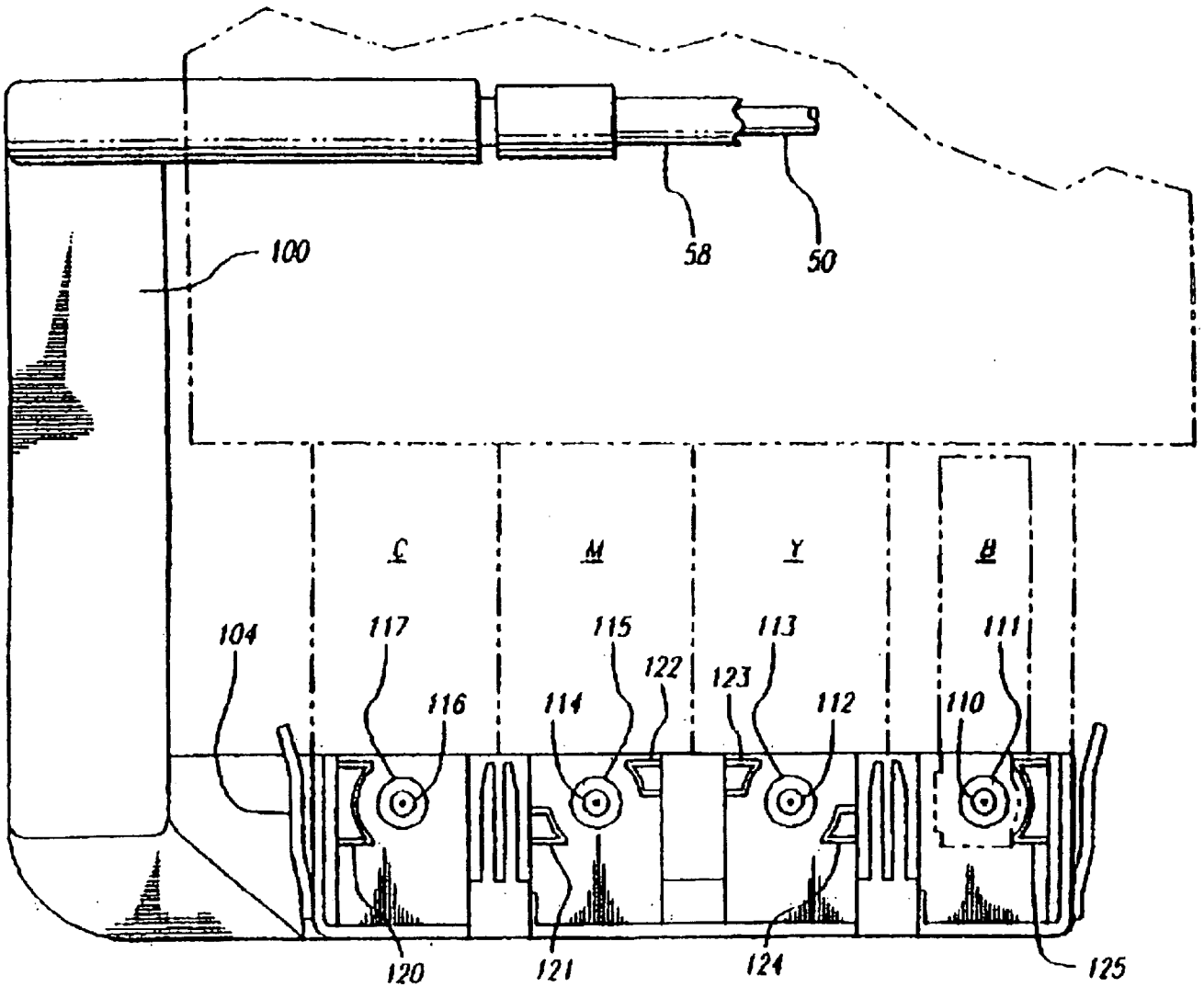
FIG. 7B is a top plan view thereof showing printhead lockouts therein with portions of the printhead carriage shown in phantom.
Figure 8:
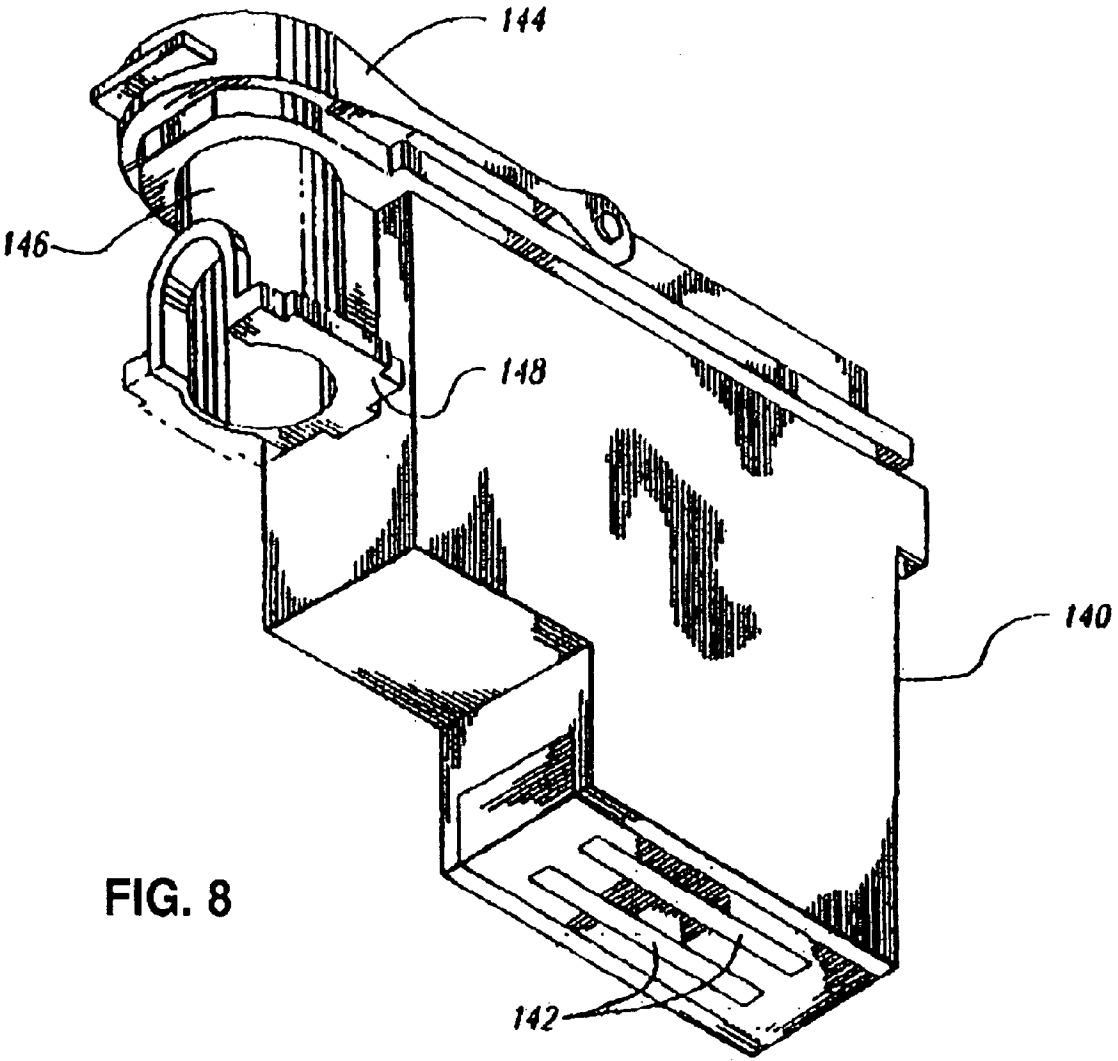
FIG. 8 is a perspective view from below of a printhead showing a lockout tab configuration which mates with the cyan color slot of the printhead connector.

The replaceable ink delivery tube system is broadly comprised of the four flexible ink delivery tubes 50, 52, 54, 56 which are all permanently connected at one end to the printhead connector 100 which is a relatively rigid plastic part best seen in FIGS. 7A–8 and, at the other end, to the reservoir connector 70 which is another relatively rigid plastic part best seen in FIGS. 9 and 12–15.

Referring now to FIGS. 7 and 8, four printheads 140 (one of which is shown in phantom in FIG. 7A)are received in the four separate stalls C, M, Y, B on the carriage 30 and have ink reception ports which respectively mate with ink delivery connectors 110, 112, 114, 116 on the printhead connector 100. Each stall has a different printhead lockout configuration comprised of various vertically extending lockout posts 120–125 formed on the printhead connector 100 in different positions around the ink delivery connector ends 110, 112, 114, 116 so that each stall is different and can only be mated with a printhead 140 of complementary configuration. By way of illustration only, the left stall C is configured to receive a printhead containing cyan colored ink. The adjacent stall M is configured to receive magenta, the next stall Y to the right is configured to receive yellow ink and the stall B at the right side of the connector 100 is configured to receive a printhead containing black ink.

FIG. 8 shows a printhead 140 configured to be received in the cyan stall of the printhead connector 100. The printhead 140 includes two rows downwardly directed inkjet nozzle 142 and a pivotally mounted handle 144 at the top for removing the printhead 104 from the carriage 30. The cyan ink delivery connector 110 on the printhead connector is received in a generally vertically extending ink receiving tube 146 on the cyan printhead. Proximate the lower end of the ink receiving tube 146 is a lockout collar 148 integrally formed with the printhead 140 with a portion shown in phantom which has been broken off or otherwise removed at the factory so that the cyan configured printhead 140 can only be receivable in the cyan stall C of the printhead connector 100 to properly connect the ink delivery connector end 116 tube with the cyan printhead 140. It will be appreciated that printheads may be mass produced with frangible collars 148 extending generally all the way around the ink receiving tube 146 and that selected portions of the collars 148 can be easily removed at the factory to thus create cyan, magenta, yellow and black printheads each having different configurations which are uniquely receivable only in the appropriate stalls of the printhead connector 100. The partially removable or frangible collars 148 may be removed at selected locations whereby the remaining portions of the collars 148 are receivable only in the mating stalls on the printhead connector. Alternatively, it will be appreciated that the printhead connector lockout posts 120, 125 may be constructed so that they are easily broken off or otherwise removed in selected areas for mating with appropriately configured printheads.

The replaceable ink delivery tube system of the present invention comprised of the flexible ink delivery tubes 50–56 and printhead connector 100 is completed by the ink reservoir connector 70 (FIGS. 9 and 12–15) which is permanently affixed to an ink supply end of the ink delivery tubes. The reservoir connector comprises a plastic frame 72 having guide channels 73 which mate with guide rails on the printer frame and a vertically extending flange 74 to which a printed circuit board PCB, not part of the present invention, is rigidly attached. The frame 72 includes a pair of vertically extending sides 76, 78 and defines four parallel connector module stalls separated by vertically extending divider walls 80, 82, 84. The frame is open at the front and rear sides so that the ink delivery ends of ink reservoirs 20, 22, 24, 26 may be received in the stalls from the front side of the printer. The front side of the reservoir connector 70 seen in FIG. 9 and shows modules, described below, having ink delivery inlets 50*i*, 52*i*, 54*i*, 56*i*, air connections 90, 91, 92, 93 and electrical connectors 94, 95, 96, 97 which mate with like connections on the reservoirs, the modules being mounted in the module stalls and extending through the stalls in the frame 72 to the rear side of the printer.

Four reservoir connector modules 200, 202, 204, 206 are resiliently mounted in each of the four stalls of the frame 72 such that the four modules are forwardly and rearwardly moveable with respect to the frame and slightly laterally moveable with respect to the frame under the influence of a pair of compression springs 208, 210 extending between each module and spring seats on the frame 72 to permit the modules to readily connect to and disconnect from the ink reservoirs 20, 22, 24, 26 which are manually inserted from the front of the printer. Each module ink port 90, 91, 92, 93 receives ink from one ink reservoir 20, 22, 24, 26, and the air connections 90, 91, 92, 93 deliver compressed air to the reservoirs.

Figure 12:
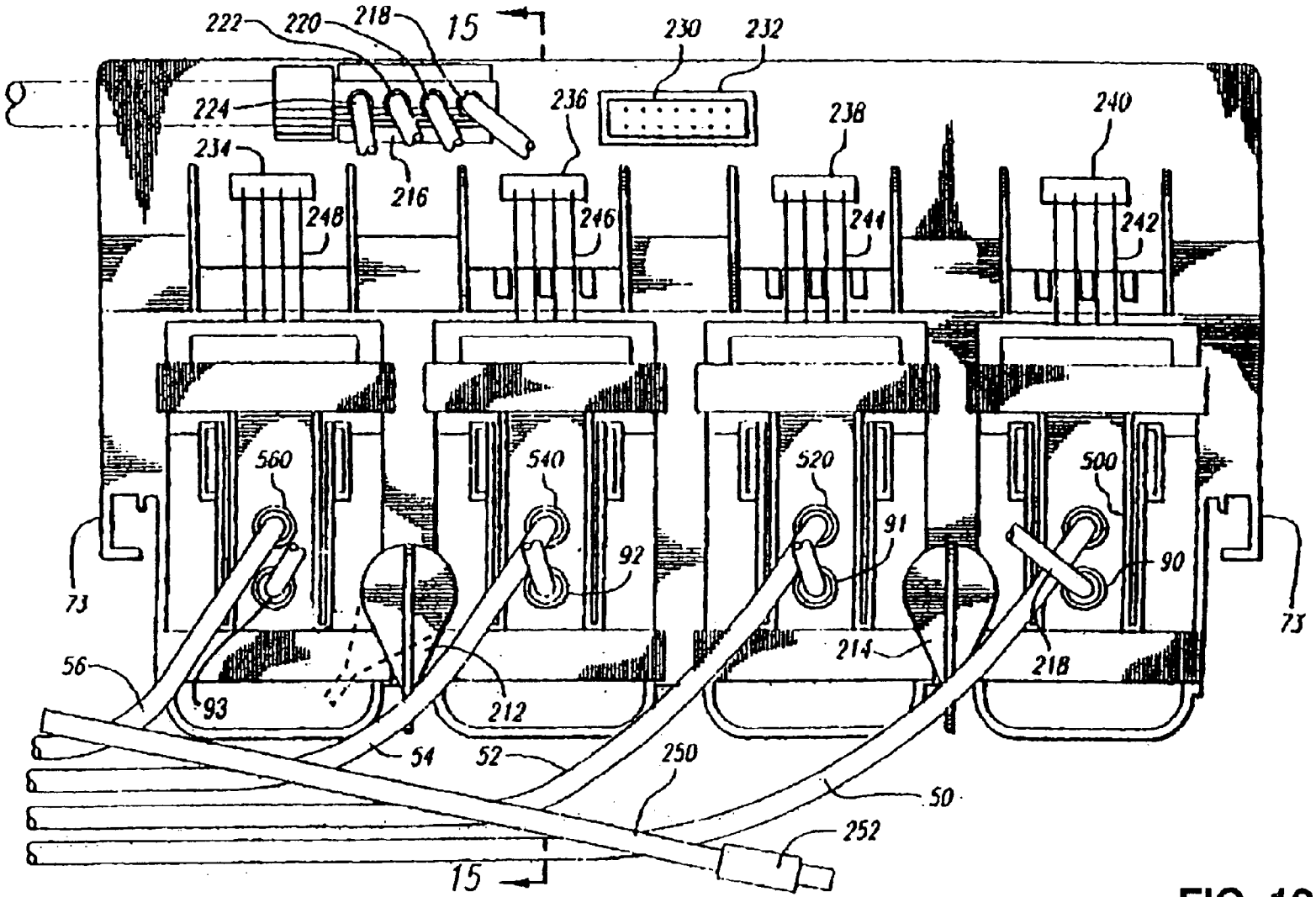
FIG. 12 is a rear elevation view of the reservoir connector.
Figure 13:
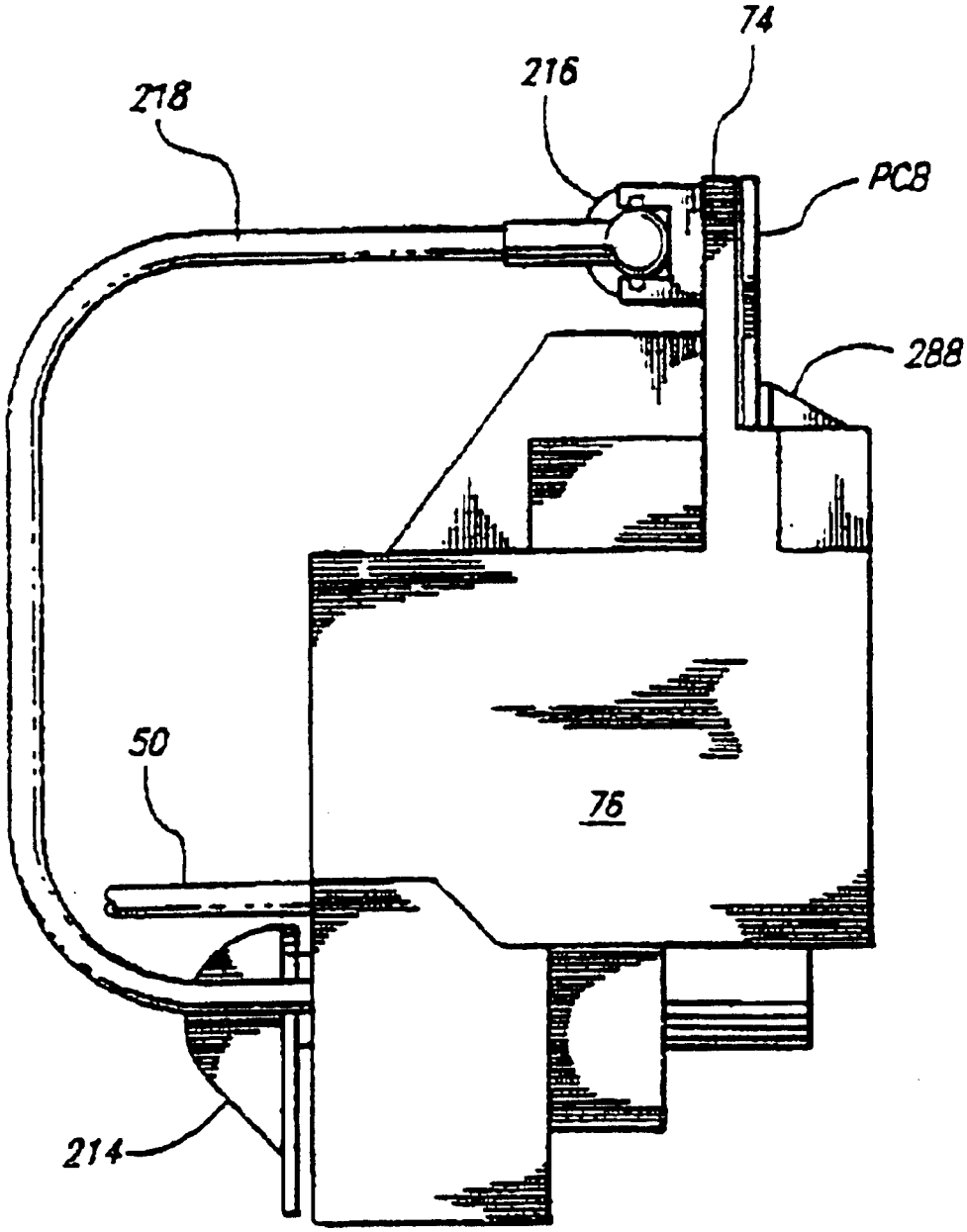
FIG. 13 is a left side elevation view of the reservoir connectior, the right side view being a mirror image thereof.
Figure 14:
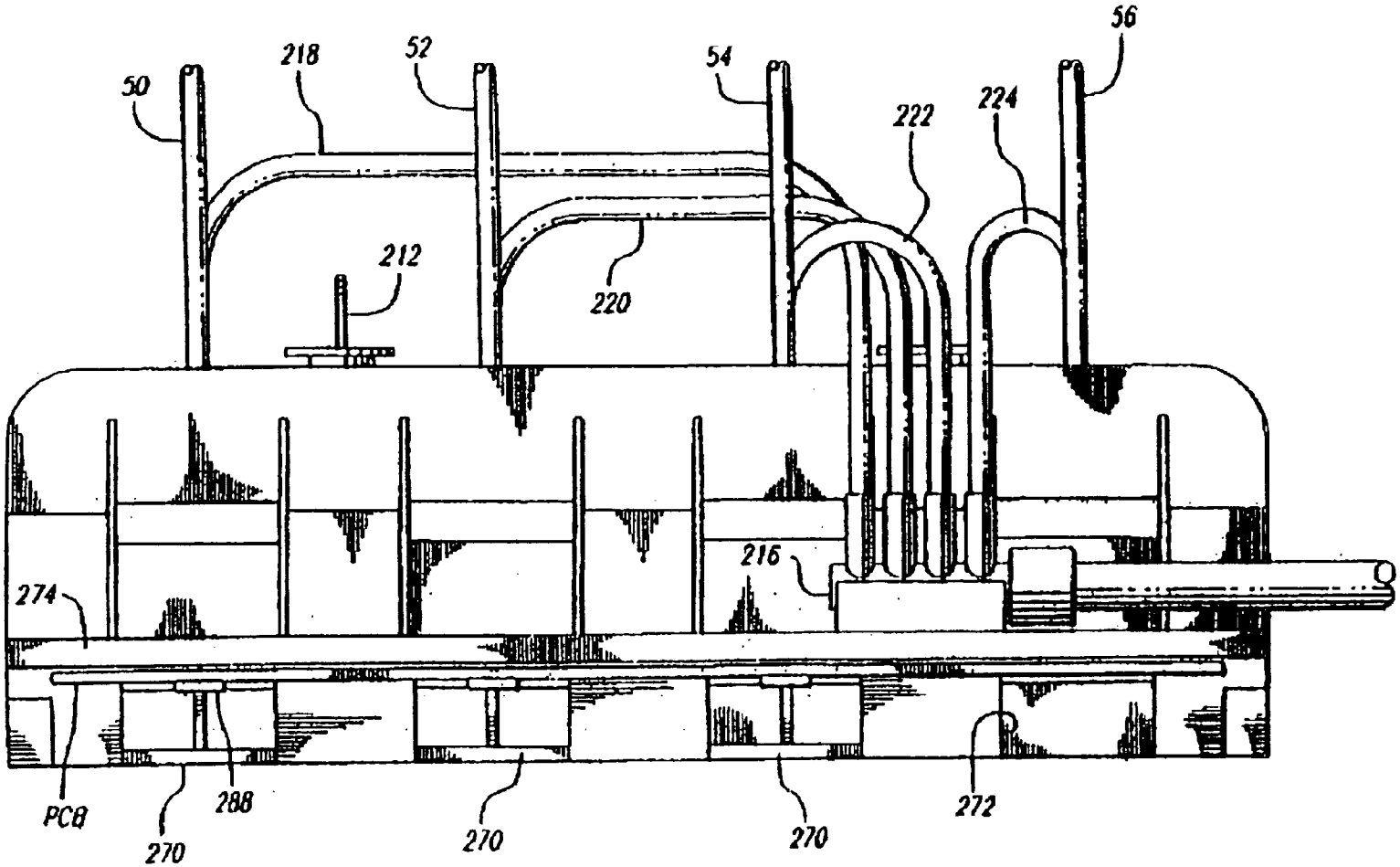
FIG. 14 is a top plan view of the reservoir connector.
Figure 15:
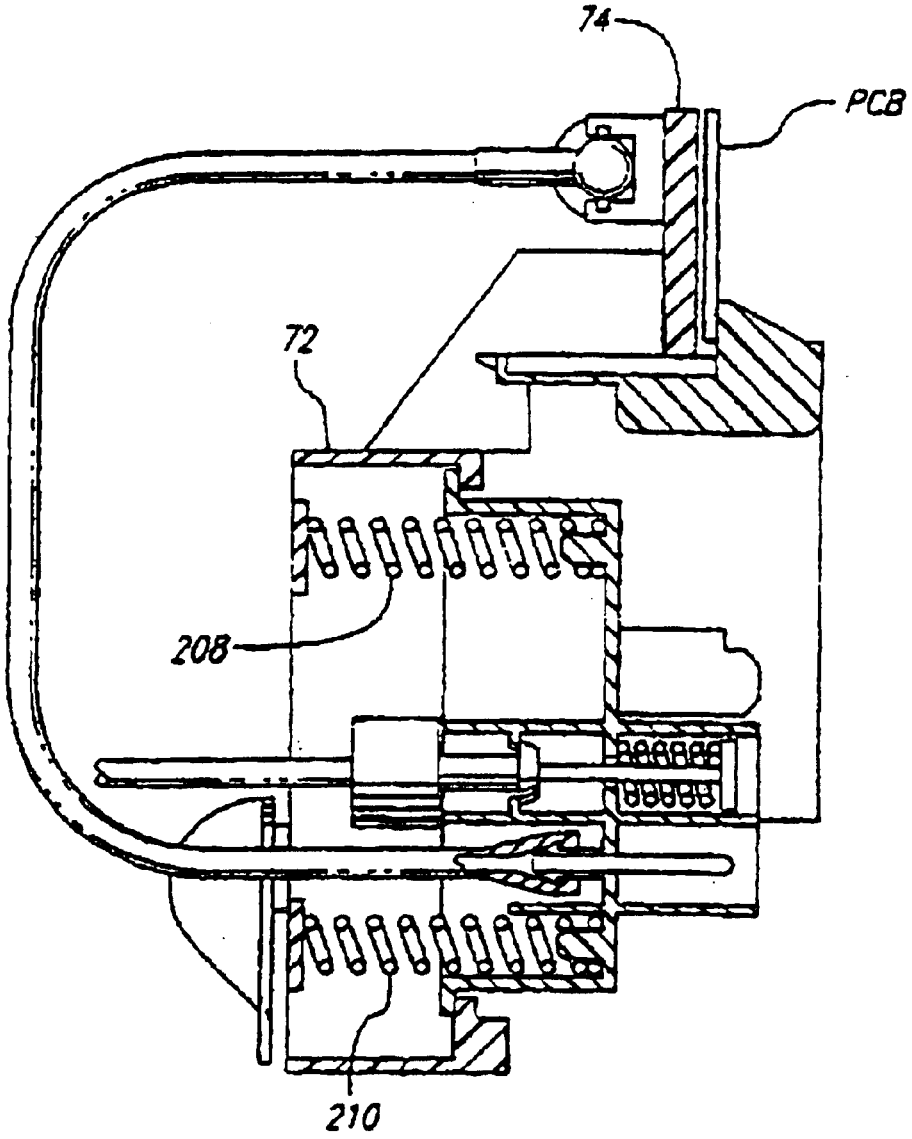
FIG. 15 is a vertical cross section of the reservoir connector showing a connector module resiliently mounted therein.

The rear side of the reservoir connector 70 as seen in FIG. 12, includes a pair of quick release twist connectors 212. 214 which are easily gripped between the thumb and fore finger which can be rotated as desired to rotate locking shafts received in apertures in the printer frame to connect and disconnect the reservoir connector 70 from the printer frame. An air delivery manifold 216 is mounted on the rear of the upwardly extending flange 74 and includes a quick release connector for connecting and disconnecting the manifold 216 to a flexible air supply line which delivers air through four tubes 218, 220, 222, 224 to the modules 200, 202, 204, 206 to pressurize each of the four ink reservoirs when connected to the modules to cause the ink reservoirs to deliver ink under pressure through the ink delivery connections 50*i*, 52*i*, 54*i*, 56*i* and the four ink supply tubes 50, 52, 54, 56 which are respectively connected to ink supply outlets 50*o*, 52*o*, 54*o*, 56*o* on the rear side of the modules. Also shown is a a main electrical connector 230 extending through an aperture 232 in the flange 74 which connects to the circuit board and four electrical connections 234, 236, 238, 240 of conductors 248, 246, 244, 242 extending from the circuit board through the frame 72 to the connectors 94–97 on the front of the modules. Disconnection of the main air supply line from the manifold 216 and disconnection of an electrical conductor strip from the main electrical connector 230 is quickly made by from the rear side of the printer so that the entire reservoir connector including the permanently connected ink delivery tubes 50, 52, 54, 56 can be removed from the printer merely by rotating the quick release connectors 212, 214. A rigid plastic tube clip 250 having a bayonet connector 252 which is readily slidably received in and removed from an aperture in the printer frame is also provided to hold the ink delivery tubes 50, 52, 54, 56 in the proper spaced relationship to each other proximate the reservoir connector 70.

Figure 9:
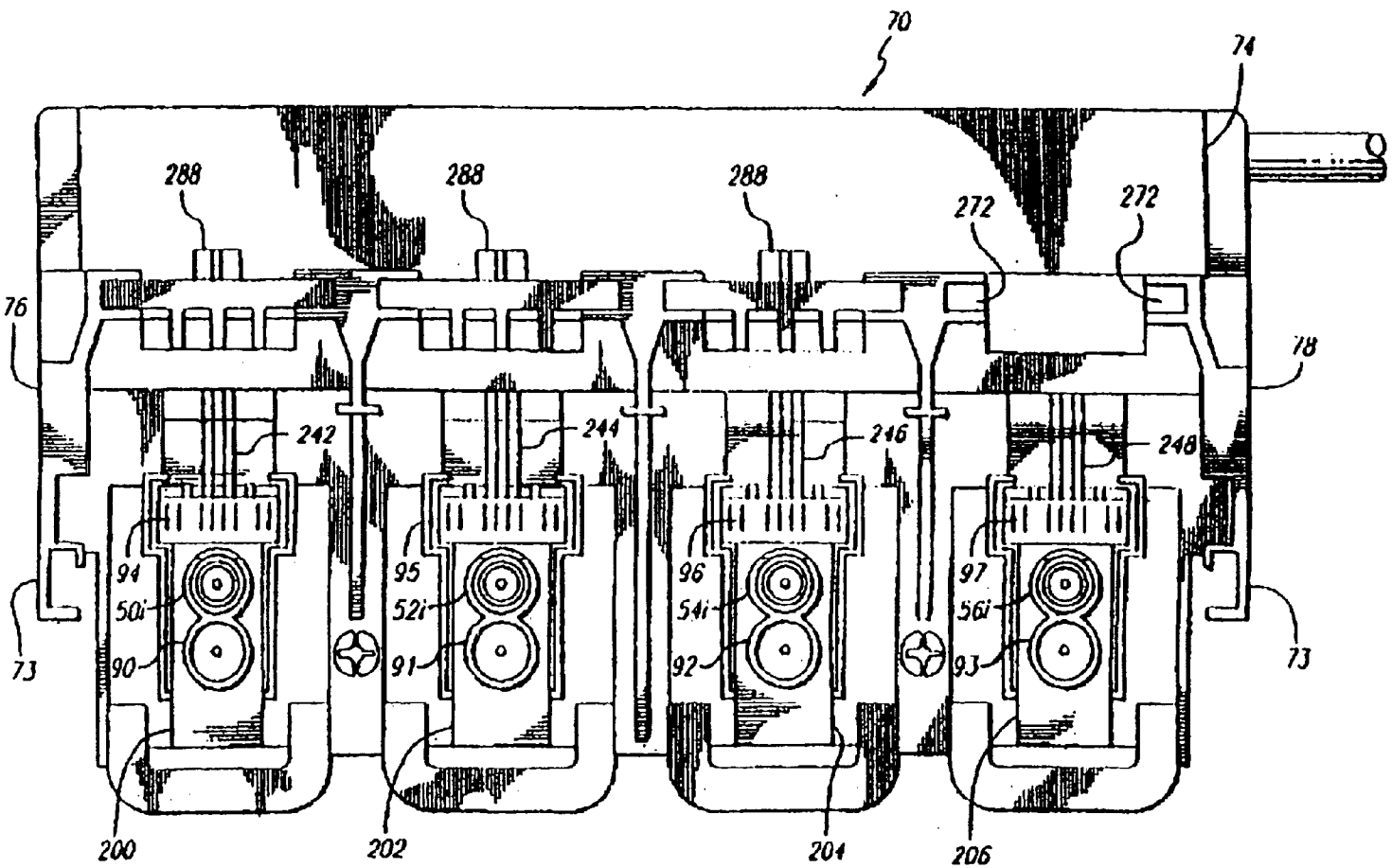
FIG. 9 is a front elevation view of the reservoir connector with one reservoir lockout removed.
Figure 10:
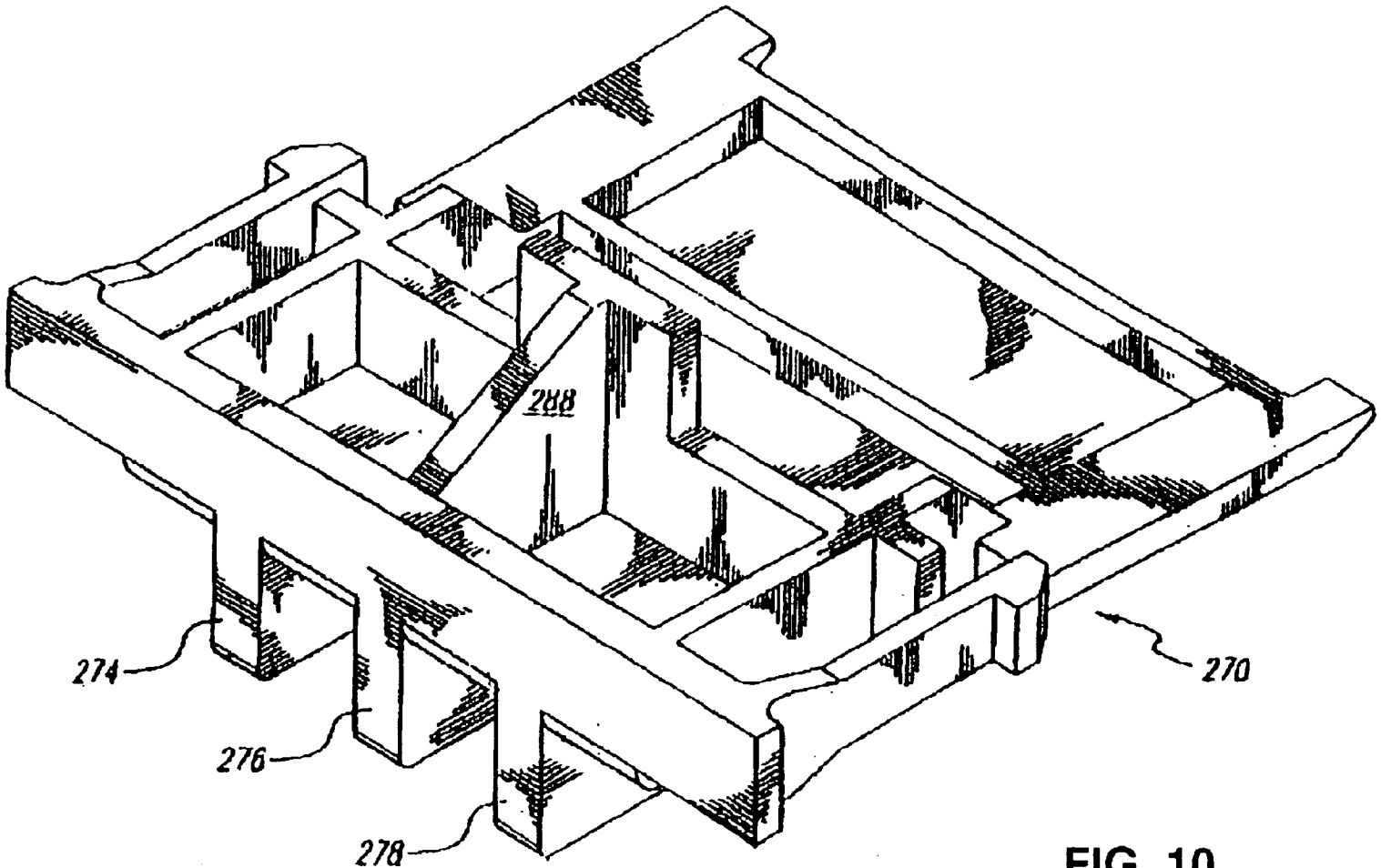
FIG. 10 is a perspective of a lockout receivable in the reservoir connector having a fin configuration complementary with the fin configuration on an ink reservoir.

Ink reservoir lockouts 270 are provided to ensure that ink reservoirs are containing only one type of ink, for example pigment based ink, can be received in the reservoir connector. In the preferred embodiment, these lockouts take the form of four separate removable members 270 slideably received in slots 272 in the top portion of the frame 72 above the four modules. In the configuration shown, each lockout 270 has three horizontally spaced downwardly extending fins 274, 276, 278 which mate with ink reservoirs having four horizontally spaced upwardly extending fins 280, 282, 284, 286 (FIG. 11) to ensure that reservoirs containing one type (not color) of ink only, e.g. pigment based ink rather than dye based ink, can be received in the frame 72. Separate lockouts are also provided near the front end of the reservoir stalls in the printer frame to ensure that reservoirs containing only the appropriate color of ink may be received in the four reservoir stalls. As seen in FIG. 9 one of the lockouts 270 has been removed to more clearly show the slots 272 in the frame in which the lockouts 270 are slideably received. Also note in FIG. 9 that the lockouts 270 each have vertically upstanding bosses 288 integrally formed thereon which, when the lockouts 270 are fully inserted into the slots 272 in the frame 72, provide an additional means of affixing the printed circuit board to the front of the upstanding flange 74 at the top of the reservoir connector frame.

It is thus seen that an easily replaceable ink delivery tube system has been provided which is uniquely useable with ink of a selected type, e.g. pigment based ink or dye based ink but not both, due to the lockouts 270 provided at the ink reservoir connector 70 and which is uniquely connectable to printheads of a selected color due to the lockout collars 148 on the printheads and the lockout posts 120–125 provided on the printhead connector 100. Removal of the entire system from the printer when it is desired to change from, e.g. pigment based ink to dye based ink, prevents fouling of the ink delivery system in a foolproof manner by inadvertent use of ink of the wrong type therein. The replaceable delivery system is easily removed from the printer merely by disconnecting the air line and electrical connections at the reservoir connector 70 so that the reservoir connector can be removed from the printer, by removing the printheads from the carriage and then disconnecting the printhead connector 100 from the carriage 30 merely by squeezing the resilient finger tabs 102, 104 while pulling the printhead connector 100 from under the carriage 30 and by removing the ink delivery tube clip from the rear tube guide 46.

It will be understood by those skilled in the art that the invention provides an integrated, modular and easily configurable flexible system to pressurize ink in order to deliver it to inkjet printheads at the required flow rate and pressure. This is especially relevant for the ink supply system of so-called regulator printheads that require continuous refilling.

The air pressure system (APS) provides and controls the pressurization of the ink in the ink cartridges during a printing operation. This ensures that the ink supplied to the inlet to the printhead is at the correct minimum pressure to ensure correct printhead function. The internal pressure in the printhead should remain within necessary limits for the desired print quality at various respective print speeds. Pressurization is particularly useful for a system where the ink supply is remote from the printhead such as off the carriage, in order to overcome pressure losses with long connecting tubes and to allow machine design flexibility for ink cartridge location and especially ink cartridge height, as well as tube diameters, fluid interconnects, etc.

The following components are particularly helpful in providing an inter-related system of air pressure monitoring and control. The air pump reliably pressurizes the air and thereby the ink to the required pressure in the required time. The pressure sensor provides measurement of the air pressure for its feedback control. The solenoid pressure valve enables rapid depressurization of the system. The mounting base locates the pump, sensor and pressure valve with associated tubing manifold, quick connection, while also providing a sump to contain possible ink leakage from the valve due to any ink leakage in the cartridge contaminating the air circuit.

The flexible tubing enables easy connection of the distributed parts of the pressure system. The various manifolds provide secure interconnection of the multiple air tubes forming the air circuit. The outer sheet of the ink cartridges effectively forms part of the air circuit, and the flexible ink bag isolates the ink from the air whilst allowing pressure transmission. The small air leak vent allows pressure equalization with the atmosphere when not printing. The restraint frame around the member holding the ink cartridges helps to resist the forces developed by the high pressure in the ink cartridges. The quick connections for the air tubes facilitates the quick coupling for the two halves of the air circuit and also results in easy replacement of certain portions of the air tubes.

It is important to note that the modular system allows for ease of modification or expansion. The programmable firmware which controls the ink pressure levels allows easy adjustment to suit individual product, printhead and ink needs. Such flexibility is enhanced by the use of an analog pressure sensor to control an oversized air pump. Also, all electro-mechanical components can be housed in the electronics shielding enclosure with the pneumatic power connection to the ink cartridges only by air, thus eliminating completely all electrical emission problems.

The pressure relief valve is normally closed. This means that the valve is closed when no voltage is applied, so that the air system circuit is fail-safe—it is closed when the machine is turned off, or in reshipping, or between plots. The valve is the only possible opening for ink of the air circuit/secondary containment when the ink cartridges are fitted in the plotter.

Each ink cartridge has its only slow leak vent with built-in filter that does not allow ink to pass. For the printer system this provides the means to avoid the system pressurizing itself with temperature or altitude changes in shipping or storage. This is also particularly useful for shipment of the individual ink cartridges separate from the printer.

The air tubing is raised above the maximum ink level in the cartridges. This is to provide a simple gravity check against any ink leak in a cartridge entering the air circuit. Moreover each cartridge has a pair of exposed contacts on the outside of the ink bag to detect ink by change in resistance. The printer checks these on machine switch on and before pressurisation for any plot. If any leak is detected the system will not pressurise and will notify the user to change that ink cartridge. This is to prevent any ink getting into the air system at all. Also, at the outlet of the pressure relief valve is a sump to catch ink ejected from a contaminated air system. There are three levels of ink containment which reduce the probability of ink ever being leaked onto a customer's carpet or floor.

As shown in the flow chart of FIGS. 18A–D of the drawings, there is a specific sequence of steps which assures that the minimum ink pressure is reached quickly before the printing operation begins. The actual air pressure required is determined at the start of each plot dependent on the volume of ink left in the cartridge since a major pressure loss contributor is the ink bag when nearly empty, and which color, since the color maximum flow rate is lower. The pressure is maintained for a predetermined wait time between plots, thus giving effectively no warm up time for the air pressure system for high throughput printing.

The housing supports the ink cartridge sides by providing spacers between the cartridges and a structural reinforcing loop of metal around the outside of the entire cartridge group. The housing provides the base which together with a sheet metal frame clipped in from the top completes the closed loop. This allows the cartridge bottle to be blow moulded for low cost using generally low rigidity materials, thereby also achieveing the industrial design needs for a book shaped form factor.

The following tables provide various data and operating ranges for the air pressure system:

TABLE I

Preferred Default Parameters For Air Pressurization System (APS)

| Parameter | Name | Value | Unit |
|---|---|---|---|
| Print pressure normal | Pnormal | 1.2 | psi |
| Print pressure Black <80 cc absolute | Pblack | 1.85 | psi |
| Print pressure Colour <80 cc absolute | Pcolour | 1.4 | psi |
| Stop pressure | Pstop | 2.25 | psi |
| Repump pressure | Prepump | 1.95 | psi |
| Pump pressure rate | Rpump | 0.2 | psi/s |
| Print pressure wait time for fine checking | Tcheck | 0.15 | s |
| Minium pump on time to reach print pressure | Tmin | 0.1 | s |
| Post plot wait time with pressure maintained | Twait | 5 | minutes |
| Pressure sensor maximum offset calibration allowed | Pcal | +0.25<br>−0.25 | psi |
| Maximum time to Pprint in first (coarse) check | | 20 | s |
| Maximum time to Pprint in fine check | | 10 | s |
| Min pressure allowed at start of swath (except first) during printing | | Pprint | psi |
| Depressurization check Max pressure after valve open 20 s | Tdep | 0.3 | psi |
| Valve open time for depressurization | Tvalve | 30 | s |

Pnormal: All cartridges operating in "normal" pressure loss range.
Pcolor: Any color cartridge in "nearly empty" range, black in normal range.
Pblack: Black in nearly empty range.

The required minimum air pressure at flow Q is given by:

$$P(air)=P(printhead\ at\ Q)+P(head\ loss)+P(flow\ losses\ at\ Q)+P(ink\ bag)$$

Where:

P(air): The pressure measured by the sensor: effectively equal to the pressure in the ink bags P(printhead): The minimum inlet pressure defined by spec. at specified pen flow rate Q P(head): Pressure loss due to the height difference between the printhead inlet and the ink bag exit.

P(flow): Pressure loss due to flow friction at specified flow rate.

P(ink bag) Pressure loss due to bag collapse resistance

TABLE II

| Key Parameters | | | |
|---|---|---|---|
| Platform maximum flow rate | 24 | cc/min | Printhead platform |
| black pen max flow rate | 20 | cc/min | Printhead platform |
| color pens max flow rate | 6 | cc/min | Printhead platform |
| min pressure[1] to ensure PQ: | Q (cc/min)/2 | psi | 0 to 20 cc/min |
| | 10 | psi | 20 to 24 cc/min |
| min pressure[1] no damage: | 0 | psi | 0 to 24 cc/min |
| inks max viscosity (max) | 5 | Centipoise | . . . platform inks |
| Inkbag pressure loss[2] (max) | 0.15 | psi | Full to 80 cc (abs) ink remaining |
| | 0.69 | psi | 80 cc to empty (99%) |
| | 1.05 | psi | 80 cc to empty (3σ) |
| Printhead inlet height above ink | 137 | mm | Small bag (350 & 175 cc) |
| bag outlet height | 161 | mm | Large bag (700 cc) |
| Pressure measurement error (max) | 0.15 | psi | Sensor & electronics errors After zero offset calibration |

[1]Defined at the inlet holes in the pen needle.
[2]Defined at the centre of the ink outlet septum.

The time to pressure is directly proportional to the air volume to be compressed, and thus depends on the cartridge size and the ink remainin in each.

Figure 19:
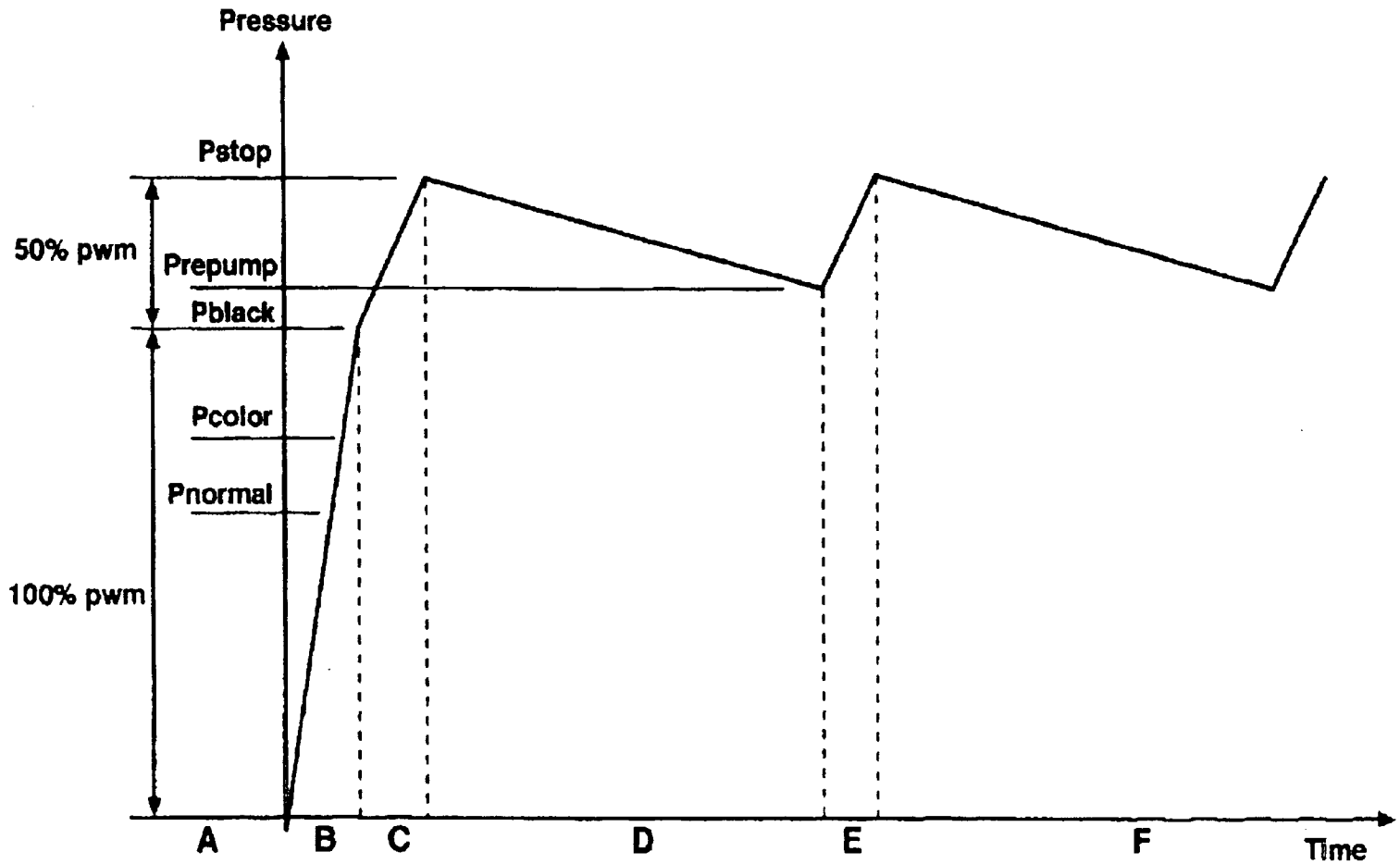
FIG. 19 shows an exemplary duty cycle for the air pressure system.

The APS following duty cycle description explains the duty cycle curve shown in FIG. 19 of the drawings:

A) System de-pressurized: pump off, valve closed. Air pressure equalisation through the Mirage vents.

B) Incoming plot detected: pump on full speed to Pblack, printing allowed as soon as Pprint reached.

C) Pblack to Pstop pump runs at half speed and stops at Pstop.

D) Pressure decays to Prepump at rate dependent on system air volume, Mirage vent leaks, system leakage, and ink use rate.

E) At Prepump pump on until Pstop reached.

F) Repeat of (D) to (F) until plot finished.

G) APS maintains (D) to (F) loop for Twait, unless plot received.

H) Valve opened for Tvalve to de-pressurize system.

Time to Pressure

This is important for the time to reach print pressure only, since after this point the APS works in the background maintaining the ink pressure. This APS "warm up time" runs in parallel with the time used for servicing at the start of any plot when the APS is de-pressurized: whichever is the longer defines the delay between plot detection and print start (assuming plot processing time is less).

The effect of leakage on the pump life requirement is also dominant: more than a minimum of 50% of the air pumped is expected to be used to replace leaked air. Air vented to atmosphere each time the system de-pressurizes is the next major contributor. While the air actually used to replace the ink used is two orders of magnitude lower. The pump duty cycle is directly affected by the leakage, but the system air volume range is also significant in defining pump off time.

Note that the vent is fitted in the cartridge to equalise pressure (and thus avoid creep of its shell) during transport. The APS uses this feature to allow pressure equalisation of the printer when de-pressurized, as the air circuit (in particular the relief valve) is normally closed.

The air pump this is a triple cylinder diaphragm pump using a swashplate mechanism driven by a DC motor. This provides a compact and quiet air compressor that allows speed control. The pump is used without an air filter on the inlet. The multiple cylinder configuration provides several important benefits: Low pumping noise and vibration; Lowered pressure pulses in the air circuit (this affects pressure measurement algorithm); Increased reliability due to parallel system redundancy.

The swashplate mechanism is extremely compact compared to the crank slider mechanism more commonly used in diaphragm air pumps.

TABLE III

| Time to Pressure Key Parameters | | | |
|---|---|---|---|
| warm up delay from "cold" | 5 | seconds | To meet throughput goals. |
| Time to print pressure | 5 | seconds | Goal for pump selection |
| for | 4 empty 350 cc | | |
| to | Pnormal | | |
| Air volume range: min: | 395 | cc | Includes 17 cc air circuit |
| 350 cc max: | 1985 | cc | |
| 700 cc max: | 3680 | cc | |
| Wait time pressurized | 5 (tbc) | minutes | To be optimised for Use Model. |

The total APS air leak rate is an important system variable for pump life and duty cycle, and for pressure checking frequency. In the APS design, the leak rates are defined as a flow rate at a pressure; the flow rate is always defined in terms of standard air (air at 14.7 psi absolute and 60° F.).

The system's dominant source of leakage is the designed-in leakage of the four ink cartridges, followed by the pump, with the valve having at least an order of magnitude lower leakage. The rest of the air circuit is airtight.

TABLE IV

| APS Pump Requirements | | | | |
|---|---|---|---|---|
| Time to Pressure Over Life | 2.5 to 2.5 for 500 with 24 | seconds psi cc V | maximum rigid volume nominal | Affects pressurization system "warm up time" before printing can start. Supply voltage. |
| Leak rate: Life start: | 1 | scc/min[1] | maximum | Affects: system air use |
| Life end: | 10 at 2.5 | scc/min psi | maximum | |
| Life | 50,000 | standard liters[2] | minimum | |
| MVBF (mean volume between failures) Duty cycle for Life and MVBF | 600,000 | standard liters | minimum | During normal lifetime. To meet 1% AFR budget. |
| Pressure capability | 3.5 | psi | minimum | 1 psi margin for platform future needs. |
| | 15 | psi | maximum | To avoid safety risks. |
| Restart pressure | 3 at 12 | psi V | minimum | To suit APS half speed repumping. 1 psi margin for platform future needs. |
| Operating voltage | 24 0 to 100 | V pwm | ±10% | supply. VOLTAGE OF PRINTER For speed control. |

[1]SCC = cc of 'standard air': air at standard atmospheric pressure and temperature.
[2]liters of "standard air": air at standard atmospheric pressure and temperature The APS design allows for relatively easy substitution of alternative pumps: since the mechanical functional connection to the APS is by air tube. In particular the use of alternative motors has been foreseen in the design of the pump mounting.

The pressure relief valve is a solenoid operated 2 way NC valve. Normally Closed (NC) means that the valve is closed when no actuating voltage applied. The valve has one port connected to the air circuit in the APS module; the exit port discharges into the ink sump. No air filtration is provided: hence, the air circuit cleanliness is important.

TABLE V

| APS Pressure Relief Valve Requirements | | | | |
|---|---|---|---|---|
| Leak rate: over Life | 0.2 | scc/min | maximum | Affects system air use |
| Operating voltage | 24 | V | ±xx | |
| Flow | xx at 2.5 | cc/min psi | ±xx | Affects de-pressurization time and ink leak detection algorithm. |
| Life | 100,000 | cycles | minimum | open/close |
| MCBF (mean cycles between failures) | 3,000,000 | cycles | minimum | During normal lifetime To meet 0.1% APR budget. |
| Duty cycle for Life and MCBF | 30 5 | s minutes | ON (open) OFF | |

The APS design allows for the easy substitution of alternative valves since the functional mechanical connection to the system is by flexible tube, and there is space to add alternative mountain clips (indeed a redundant clip to suit standard ISO size is already built in the support).

The pressure sensor is a silicon piezoresistive device with integrated temperature compensation and signal conditioning (amplification). The sensor measures gauge pressure and hence has a single pressure port that is connected to the air circuit in the APS module.

TABLE VI

| APS Pressure Sensor Requirements | | | | |
|---|---|---|---|---|
| Pressure range | 0 to 3.5 | psi | | |
| Accuracy | ±0.1 | psi | | |
| Maximum pressure | 15 | psi | No damage | Equal to pump max |

TABLE VI-continued

| APS Pressure Sensor Requirements | | | |
|---|---|---|---|
| | | | possible pressure |
| Supply voltage | 5 | V | |

Space is provided in the APS support for alternative sensors.

Figure 16:
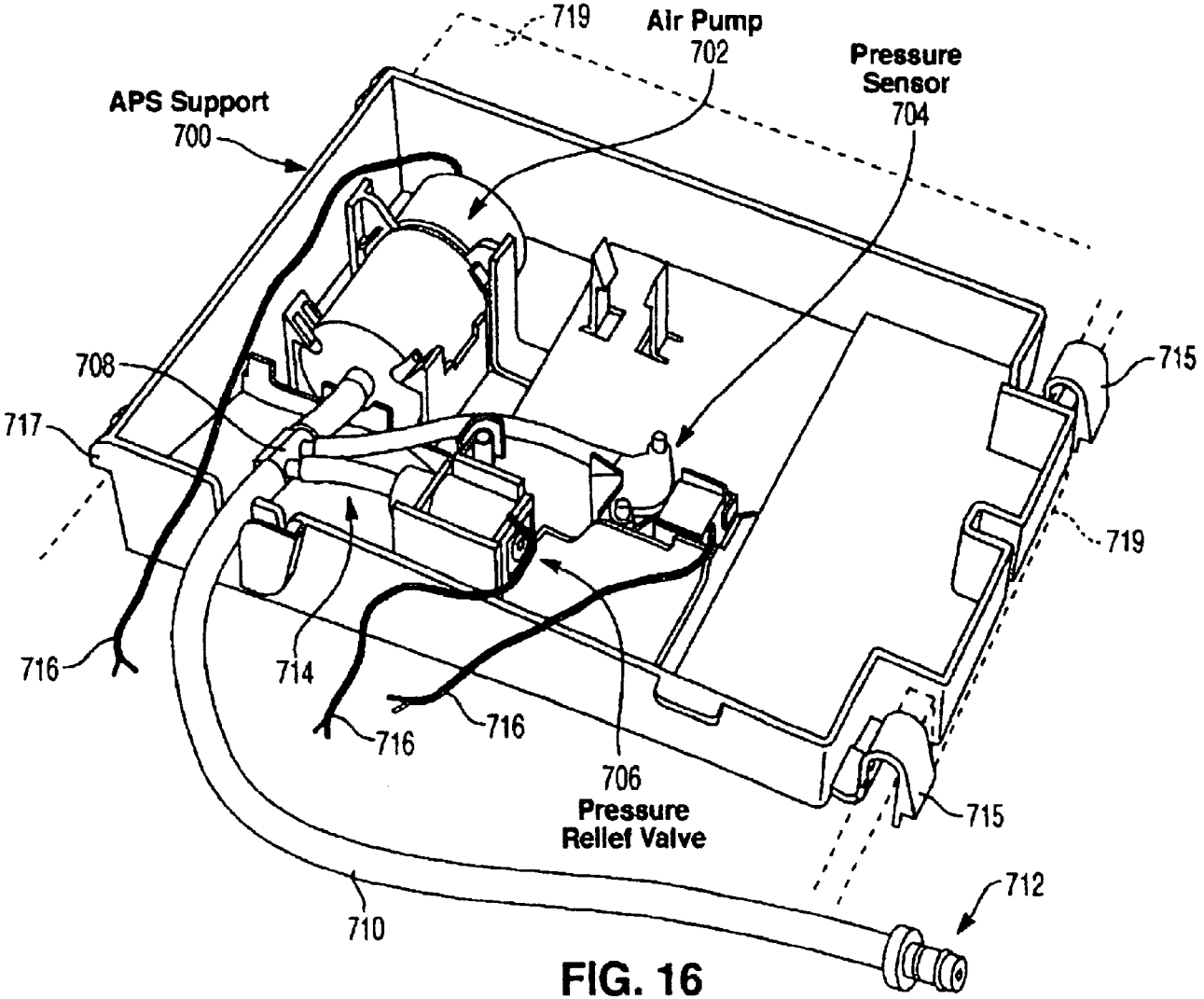
FIG. 16 is a top perspective view of a support member holding an air pump, pressure sensor and pressure relief valve.
Figure 17:
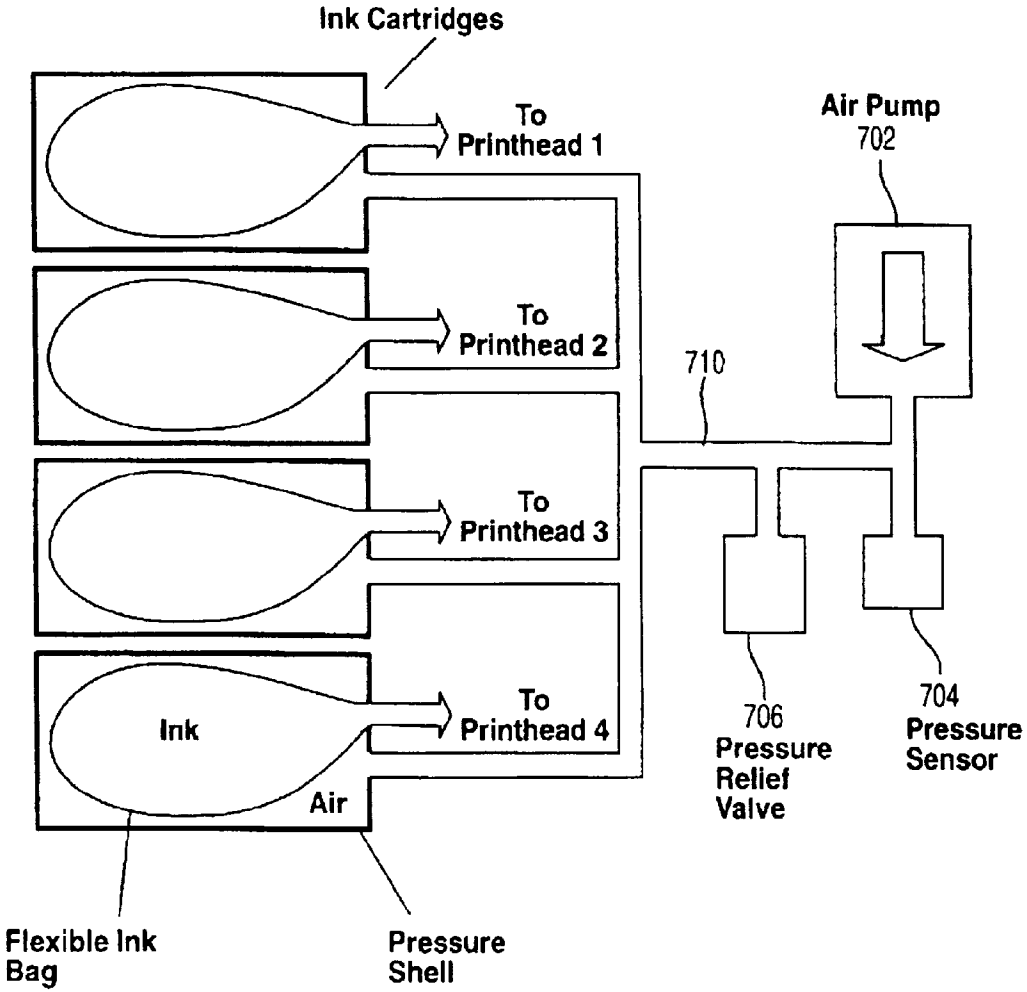
FIG. 17 is a schematic diagram of the air pressure system.
Figure 18A:
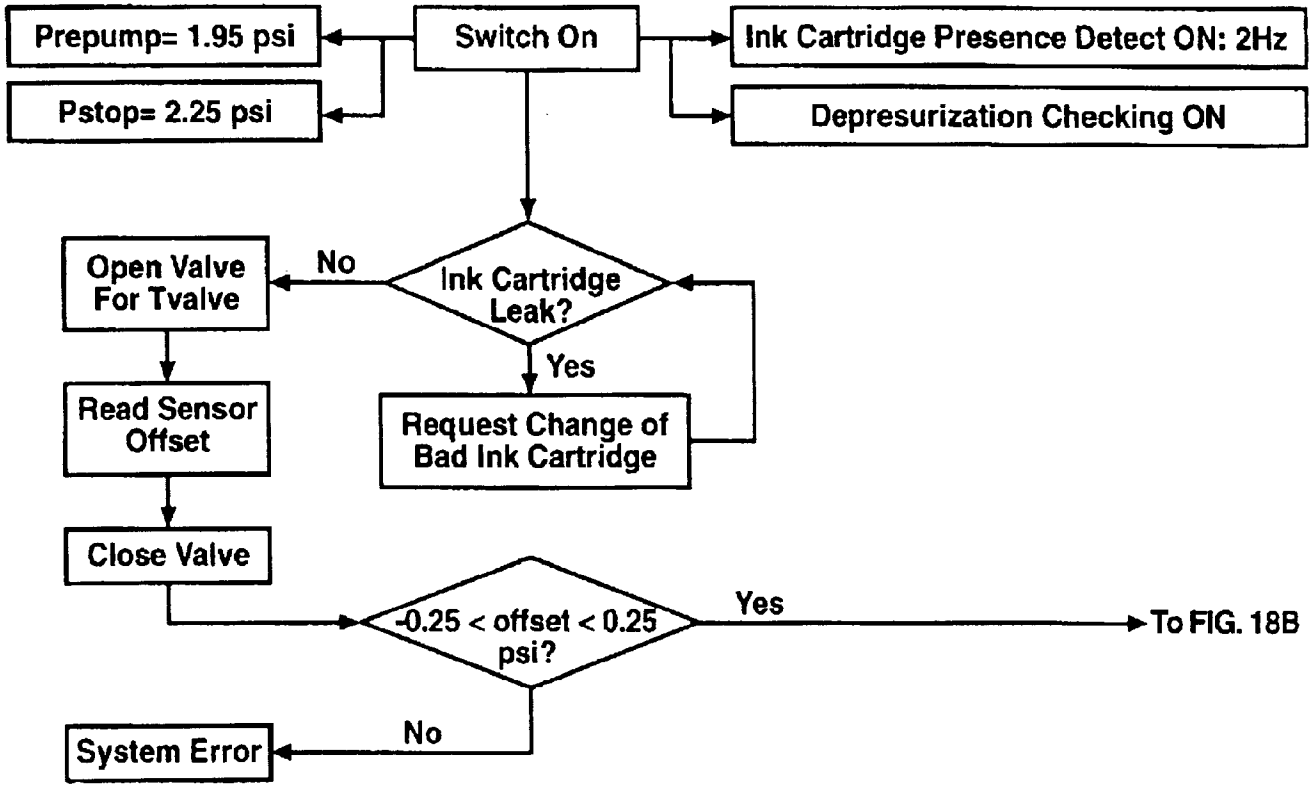
FIGS. 18A through 18D depict a flow diagram showing a presently preferred operational sequence for the air pressure system.
Figure 18B:
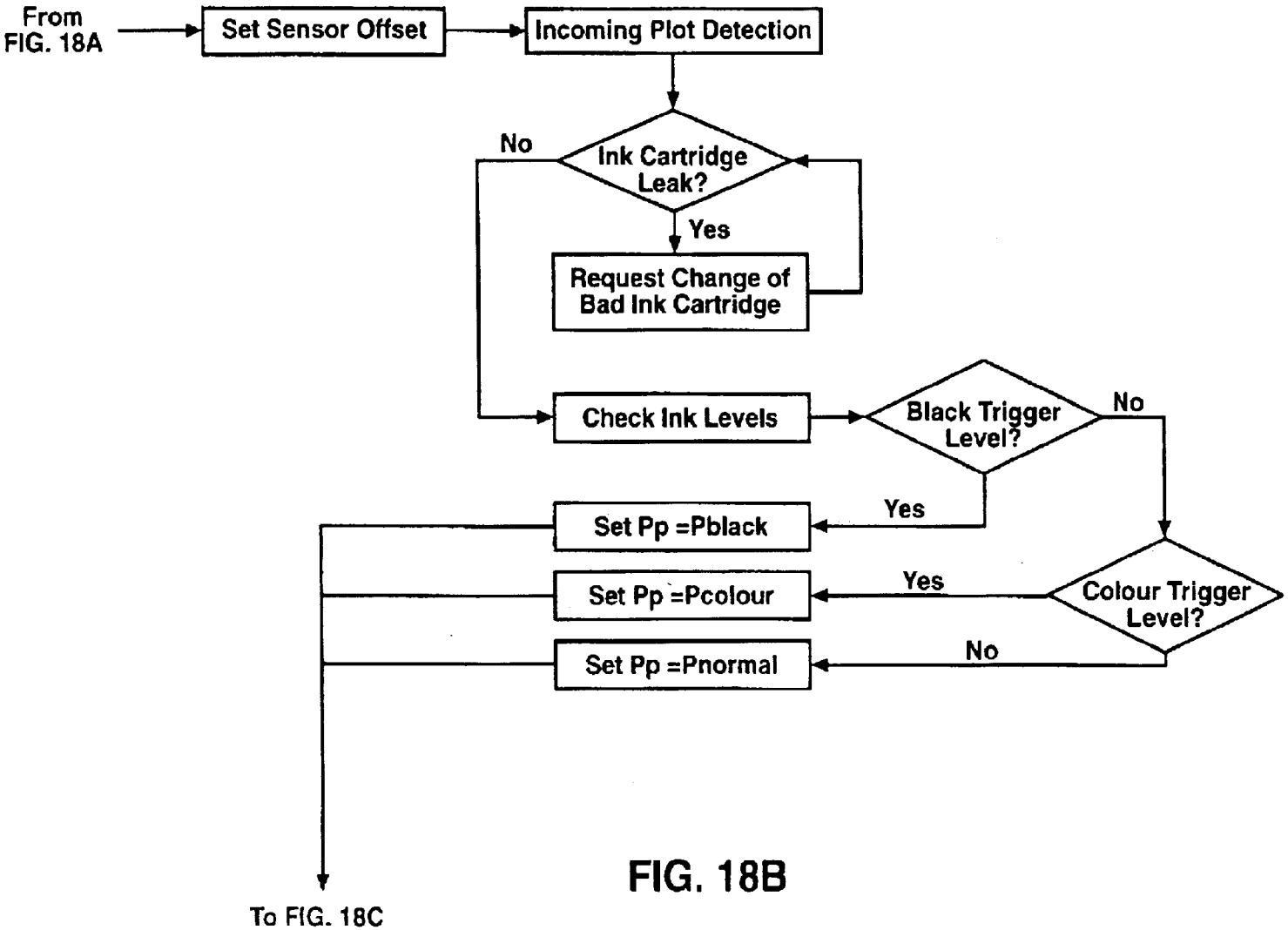
Figure 18C:
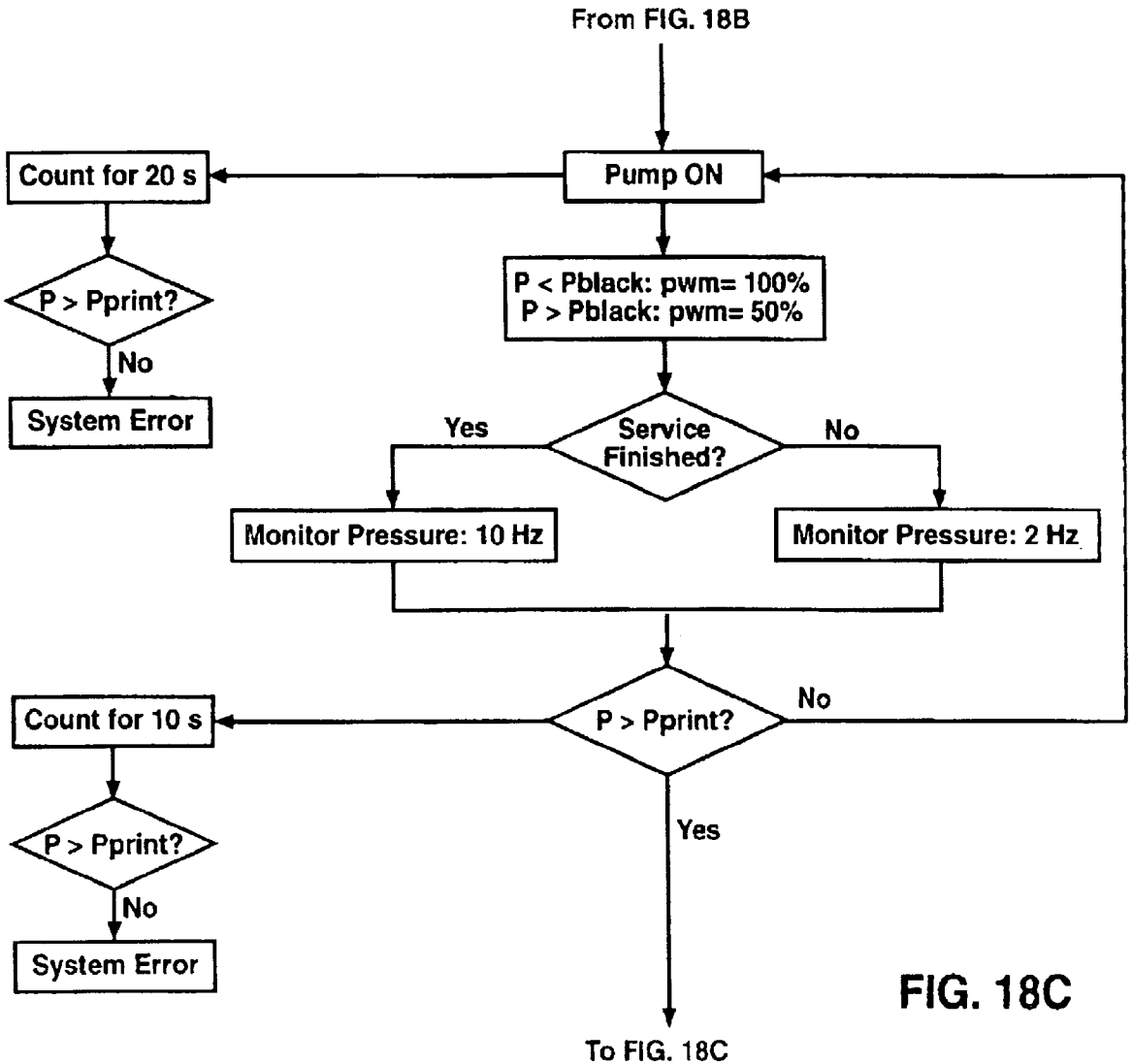
Figure 18D:
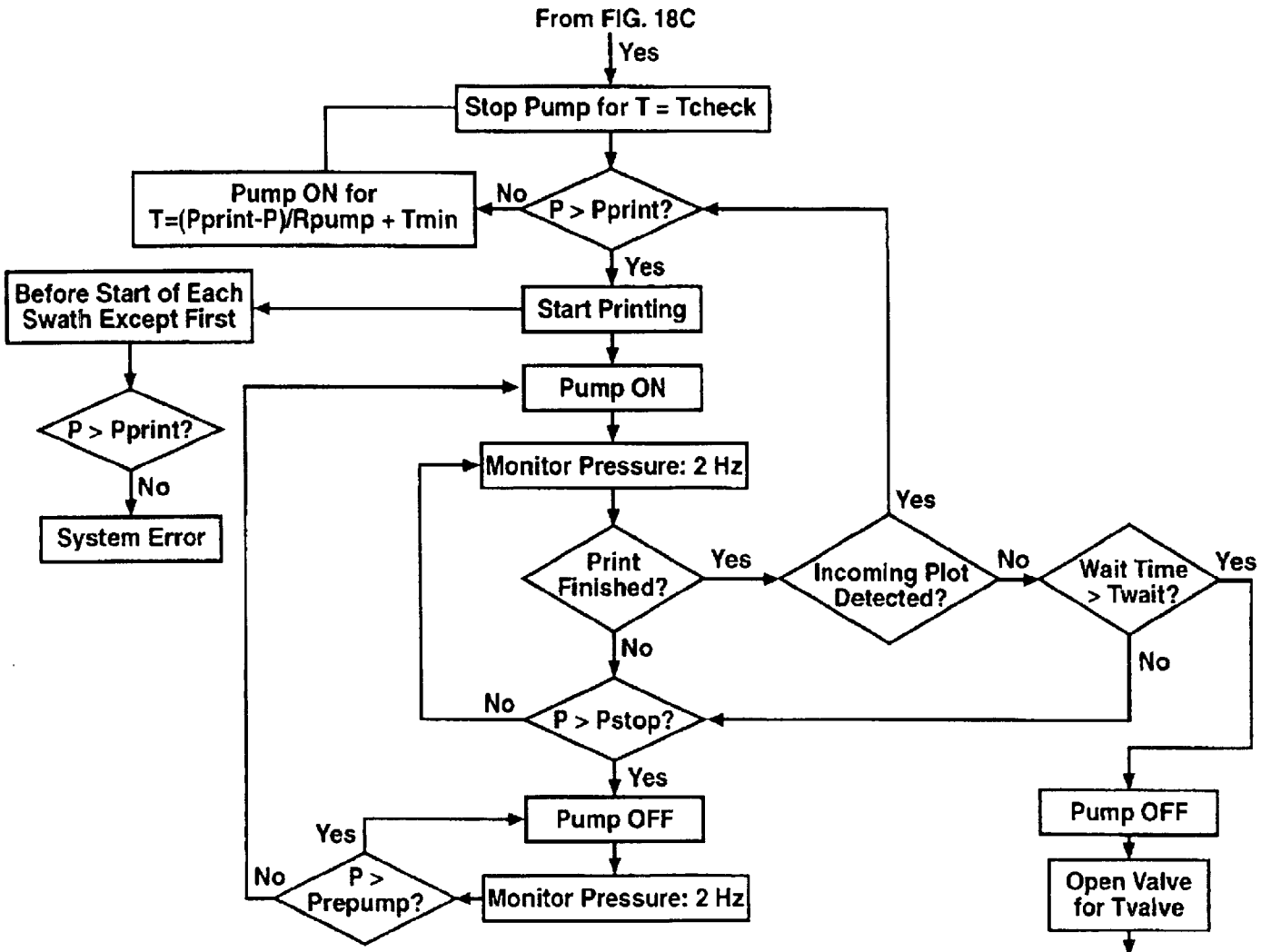

Referring to FIGS. 16–17, an air system support frame 700 carries an air pump 702, a pressure sensor 704, and a pressure relief valve 706 which all connect through adaptor 708 to flexible conduit 710 having a locking connector 712 for attachment to the manifold on the back of the ink connector member. The frame is in a modified cup shape to create a sump 714 under the pressure relief valve for collecting any ink which may leak from the ink container through the air lines. These air system components each have electrical power supply lines, with a three-wire line 716 connected to the pressure sensor for transmission of data to the control electronics. The frame 700 includes hooks 715 and tabs 717 for mounting under the connector module at its front end as shown by dotted lines 719.

The self-explanatory flow charts of FIGS. 18A–18D when combined with the data and information of the various previous tables show the sophisticated monitoring and control procedures which can be customized by merely changing firmware without having to change individual physical components in the system. Various protective steps assure that any malfunction in the system will be detected and appropriate error signals generated to alert a user and where necessary stop and/or close down the system until a problem is resolved. The flow charts of FIGS. 18A–D are best understood by reference to the exemplary APS duty cycle graph shown in FIG. 19. The Print Pressure (Pp) is set at plot start as one of Pblack, Pcolor, Pnormal. Above the maximum print pressure the pump runs at 50% pwm.

Figure 20B:
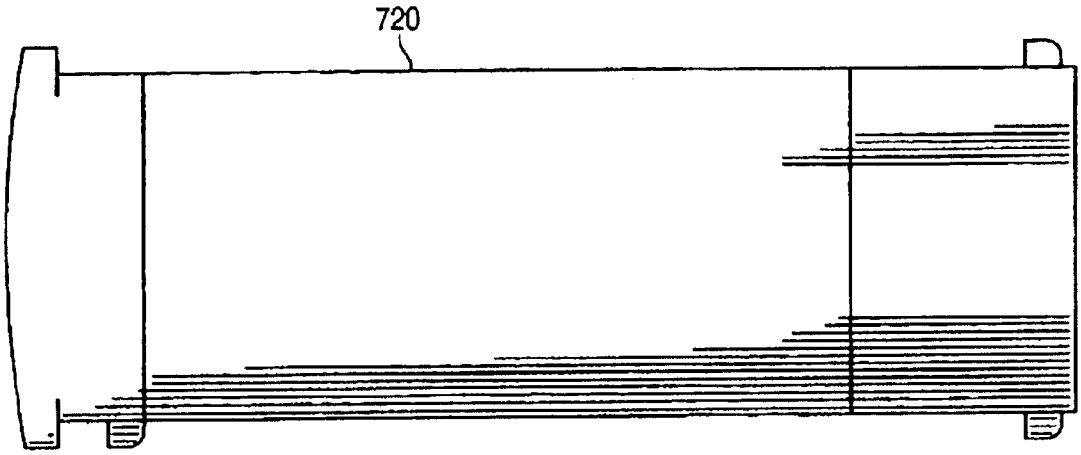
FIGS. 20A and 20B show a side-by-side comparison of a 350 cc and a 700 cc ink reservoir, respectively.
Figure 20A:
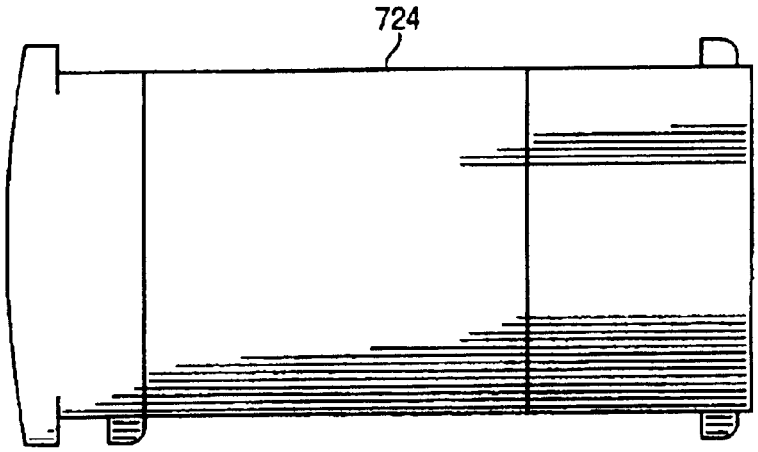

Additional flexibility is provided for different lengths (volumes) of ink containers as shown in FIG. 20. When a smaller container 724 is used, a slot 722 is engaged by a fastener twist connector 212) to lock the connector module in a shortened position (See FIG. 5B). When a larger container 720 is used, another slot 726 is engaged by the fastener to lock the connector module in a lengthened position. The twist connector 212 in unlocked position is shown in phantom in FIG. 12.

Figure 22:
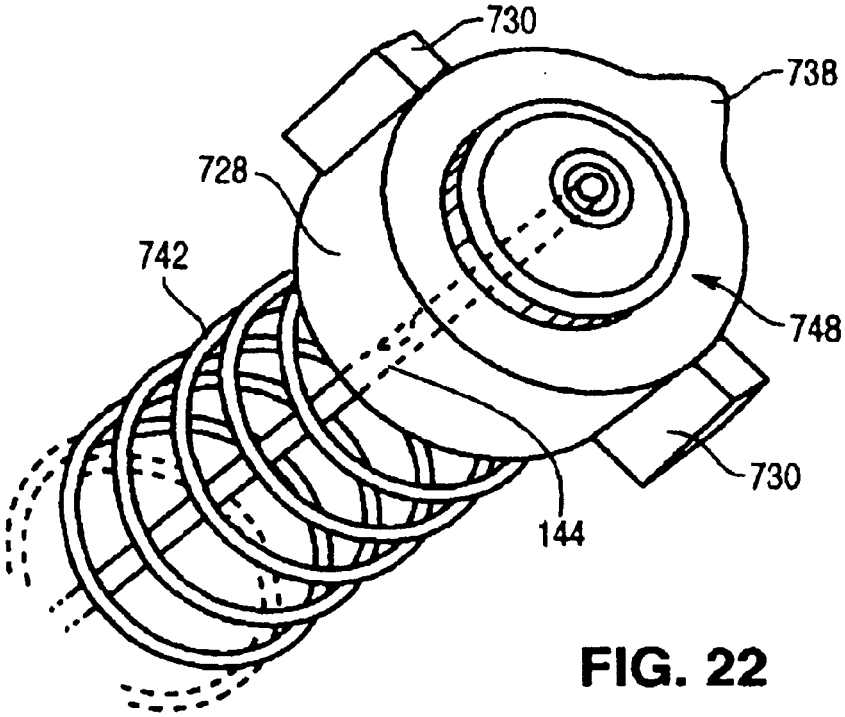
FIG. 22 shows a schematic view of a humidor with an ink needle shown inside.
Figure 21:
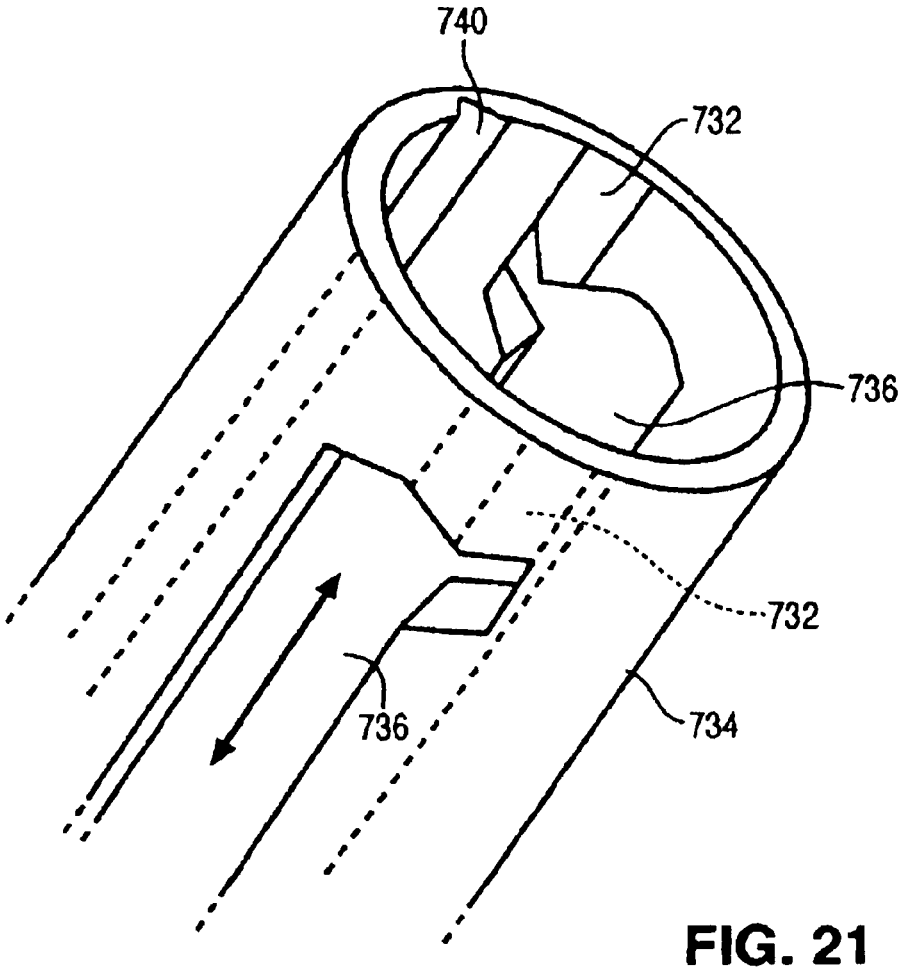
FIG. 21 shows a schematic view of a tower on the reservoir connector with the humidor and ink needle removed.

Sturdy and leak-resistant construction for the ink connection is assured by a unique tower/humidor combination See FIGS. 21–22. The humidor 728 includes opposing raised fins 730 which initially slide down matching grooves 732 in a tower 734 until they reach matching slots 736 which cause the humidor to slightly rotate so that triangular fin 738 engages a matchin elongated notch 740 thereby holding the humidor in position against a biasing spring 742. The humidor itself covers needle 744 and its ink passage 746 until compressed by a septum of an ink supply container to expose the ink passage. A facing of different concentric layers 748 abuts the septum to help prevent ink leakage.

Additional structural support for the ink containers when mounted and subjected to the rising air pressures in the containe is provided by a sheet metal loop 750 (See FIG. 5A).

It will be appreciated that the latest embodiment of the air pressure system and related components provides very predictable and secure control of the ink pressure whether applied to normal printing operations, or to unusual events such as priming, air purging of the ink tubes and the like as shown in the table of FIG. 23.

Various changes and improvements can be made to the illustrated embodiments disclosed herein without departing from the spirit and scope of the invention as set forth in the following claims.

We claim as our invention:

1. A system for ink replenishment for an inkjet printer comprising:

a frame for holding one or more ink supply modules;

an interconnect member on said frame, said interconnect member having an ink supply interface and an air supply interface;

an ink supply module mountable on said frame for coupling to said ink supply interface and for coupling to said air supply interface so that ink in said ink supply module may be subjected to predetermined positive pressures greater than ambient air pressure;

an air compressor device in communication with said air supply interface to provide variable air pressure to said ink supply module to facilitate a startup non-printing mode prior to reaching a minimum threshold positive pressure and a different operational printing mode after reaching the minimum threshold positive pressure for transmission of liquid ink from said ink supply module to an inkjet print cartridge;

a sensor for monitoring the air pressure of said air compressor device;

control electronics coupled to said air compressor device and to said sensor to control said air compressor device based on signals received from said sensor in order to provide greater air pressure from said air compressor device during said startup non-printing mode thereby reducing startup time; and a plurality of ink supply modules all connected to said air supply interface so that ink in said plurality of ink supply modules may be subjected to predetermined positive pressures greater than ambient air pressure.

2. The system of claim 1 which further includes liquid ink inside of said ink supply module.

3. The system of claim 1 which further includes an air leak vent in said ink supply module to allow pressure equalization with the atmosphere during shipping, or storage, or non-printing.

4. The system of claim 1 wherein said control electronics controls the air pressure of said air compressor device by operating said air compressor at a given high speed during said startup non-printing mode.

5. The system of claim 4 wherein said control electronics controls the air pressure of said air compressor device by operating said air compressor at a lesser speed during said different operational printing mode.

6. The system of claim 1 wherein said plurality of ink supply modules includes a black ink module and a color ink module, and wherein the minimum threshold positive pressure required in order to commence said different operational printing mode is based on operational parameters of said black ink module.

7. The system of claim 1 wherein said plurality of ink supply modules includes a black ink module and a color ink module, and wherein the minimum threshold positive pressure required in order to commence said different operational printing mode is based on operational parameters of said color ink module.

8. The system of claim 1 wherein the minimum threshold positive pressure required in order to commence said different operational printing mode is based on a determination of an amount of ink left in said ink supply module.

9. The system of claim 1 wherein said ink supply module is removably installable on said frame.

10. The system of claim 9 wherein said ink supply module includes liquid ink from the following group: black, cyan, magenta, yellow.

11. A method of providing ink from an external ink supply to an inkjet printhead comprising:

providing an auxiliary supply of ink in a collapsible bag inside of a protective enclosure;

connecting the auxiliary ink supply with a print cartridge through an ink delivery conduit;

subjecting the collapsible bag to air pressure greater than ambient air pressure to facilitate transmission of the ink from the auxiliary supply of ink to the print cartridge during ink ejection from the inkjet printhead;

monitoring the air pressure of said subjecting step;

controlling operation of an air compressor in order to accelerate an increase of the air pressure applied to the collapsible bag during a non-printing startup mode as well as stabilize the air pressure applied to the collapsible bag during a different operational printing mode in accordance with predetermined parameters;

providing a plurality of inkjet printheads each respectively connected to its own separate auxiliary supply of ink;

subjecting all of the separate auxiliary supplies of ink to a predetermined sequence of air pressures greater than ambient air pressure; and further providing an auxiliary supply of black ink and a separate auxiliary supply of color ink, and applying increased air pressure during a startup mode until reaching a minimum threshold positive pressure based on black or color ink printing parameters, and then applying a different lower air pressure during an operational printing mode.

12. A method of providing ink from an external ink supply to an inkjet printhead comprising:

providing an auxiliary supply of ink in a collapsible bag inside of a protective enclosure;

connecting the auxiliary ink supply with a print cartridge through an ink delivery conduit;

subjecting the collapsible bag to air pressure greater than ambient air pressure to facilitate transmission of the ink from the auxiliary supply of ink to the print cartridge during ink ejection from the inkjet printhead;

monitoring the air pressure of said subjecting step;

controlling operation of an air compressor in order to accelerate an increase of the air pressure applied to the collapsible bag during a non-printing startup mode as well as stabilize the air pressure applied to the collapsible bag during a different operational printing mode in accordance with predetermined parameters;

providing a plurality of inkjet printheads each respectively connected to its own separate auxiliary supply of ink;

subjecting all of the separate auxiliary supplies of ink to a predetermined sequence of air pressures greater than ambient air pressure; and further providing an auxiliary supply of black ink and a separate auxiliary supply of color ink, and applying different air pressure during a startup mode or an operational mode based on a determination of an amount of ink left in the auxiliary ink supplies.

13. The method of claim 12 which further includes reducing the air pressure applied to the collapsible bag to maintain the air pressure below a predetermined maximum level.

14. The method of claim 12 which further includes leaking air from the protective enclosure to prevent undesirable excessive air pressure applied to the collapsible bag.

15. A method of providing ink from an external ink supply to an inkjet printhead comprising:

providing an auxiliary supply of ink in a collapsible bag inside of a protective enclosure;

connecting the auxiliary ink supply with a print cartridge through an ink delivery conduit;

subjecting the collapsible bag to air pressure greater than ambient air pressure to facilitate transmission of the ink from the auxiliary supply of ink to the print cartridge during ink ejection from the inkjet printhead;

monitoring the air pressure of said subjecting step;

controlling operation of an air compressor in order to accelerate an increase of the air pressure applied to the collapsible bag during a non-printing startup mode as well as stabilize the air pressure applied to the collapsible bag during a different operational printing mode in accordance with predetermined parameters;

providing a plurality of inkjet printheads each respectively connected to its own separate auxiliary supply of ink;

subjecting all of the separate auxiliary supplies of ink to a predetermined sequence of air pressures greater than ambient air pressure; and further operating an air compressor at a first speed during the non-printing startup mode, and operating the air compressor at a lesser speed during the different operational print mode to maintain the air pressure applied to the collapsible bag during the operational print mode above a minimum operation pressure for a printhead as well as below a predetermined maximum operating pressure.

* * * * *

UNITED STATES PATENT AND TRADEMARK OFFICE

CERTIFICATE OF CORRECTION

PATENT NO. : 6,874,872 B2
APPLICATION NO. : 09/912406
DATED : April 5, 2005
INVENTOR(S) : Richard H Lewis et al.

It is certified that error appears in the above-identified patent and that said Letters Patent is hereby corrected as shown below:

On the title page, item (73), in "Assignee", delete "Development," and insert -- Development Company, --, therefor.

In column 1, line 63, after "off-board" insert -- ink --.

In column 2, line 11, after "that" insert -- the --.

In column 2, line 27, after "port for" insert -- the --.

In column 5, line 24, delete "season" and insert -- sensor --, therefor.

In column 9, line 42, delete "plan" and insert -- plain --, therefor.

In column 15, line 6 (TABLE II), delete "10 psi 20 to 24 cc/min".

In column 15, line 7 (TABLE II), delete "0 to 24 cc/min" and insert -- 20 to 24 cc/min --, therefor.

In column 15, line 11 (TABLE II), delete "(3σ)" and insert -- (3c) --, therefor.

In column 17, line 42 (TABLE V), delete "s" and insert -- 5 --, therefor.

In column 19, line 28, delete "containe" and insert -- container --, therefor.

Signed and Sealed this

Twenty-ninth Day of December, 2009

David J. Kappos

David J. Kappos
*Director of the United States Patent and Trademark Office*